US011077444B2

(12) United States Patent
Donnelly et al.

(10) Patent No.: US 11,077,444 B2
(45) Date of Patent: Aug. 3, 2021

(54) PACKAGING FOR A MOLECULAR DIAGNOSTIC CARTRIDGE

(71) Applicant: Roche Molecular Systems, Inc., Pleasanton, CA (US)

(72) Inventors: Doran Donnelly, Redwood City, CA (US); Travis Wong, San Jose, CA (US)

(73) Assignee: Roche Molecular Systems, Inc., Pleasanton, CA (US)

( * ) Notice: Subject to any disclaimer, the term of this patent is extended or adjusted under 35 U.S.C. 154(b) by 374 days.

(21) Appl. No.: 15/982,148

(22) Filed: May 17, 2018

(65) Prior Publication Data

US 2018/0339294 A1 Nov. 29, 2018

Related U.S. Application Data

(60) Provisional application No. 62/510,013, filed on May 23, 2017.

(51) Int. Cl.
*B01L 3/00* (2006.01)
*B65B 1/04* (2006.01)
(Continued)

(52) U.S. Cl.
CPC ..... *B01L 3/527* (2013.01); *B65B 1/04* (2013.01); *B65B 55/02* (2013.01); *B65D 75/327* (2013.01);
(Continued)

(58) Field of Classification Search
CPC .... B01L 3/527; B01L 3/523; B01L 2200/141; B01L 2200/16; B01L 2300/042;
(Continued)

(56) References Cited

U.S. PATENT DOCUMENTS 4,057,148 A 11/1977 Meyer et al.
4,861,709 A 8/1989 Ulitzur et al.
(Continued)

FOREIGN PATENT DOCUMENTS

CA 1094477 1/1981
DE 1994/4423935 A1 1/1996
(Continued)

OTHER PUBLICATIONS

KeyPath MRSA/MSSA Blood Culture Test—BT, 510(k) Summary, MicroPhage, Inc., Apr. 29, 2011, 15 pages.
(Continued)

*Primary Examiner* — Matthew D Krcha
*Assistant Examiner* — Jacqueline Brazin

(57) ABSTRACT

Package assemblies for storing diagnostic cartridges or storing wet/dry reagents are described herein. In some embodiments, an apparatus includes a tray member defining a first volume and a second volume, and a cover member coupled to the tray member covering the first volume and the second volume. The tray member includes a central portion that separates the first volume from the second volume. The first volume is configured to receive a desiccant package and a sample container containing a first reagent. The first reagent has a solid form. The second volume is configured to receive a reagent module containing a second reagent. The second reagent has a liquid form. The cover member and the central portion of the tray member are configured to isolate the first volume from the second volume.

23 Claims, 18 Drawing Sheets

(51) Int. Cl.
*B65B 55/02* (2006.01)
*B65D 75/32* (2006.01)
*F04B 49/10* (2006.01)

(52) U.S. Cl.
CPC ..... *B01L 3/523* (2013.01); *B01L 2200/141* (2013.01); *B01L 2200/16* (2013.01); *B01L 2300/042* (2013.01); *B01L 2300/044* (2013.01); *B01L 2300/0609* (2013.01); *B01L 2300/105* (2013.01); *B65D 2575/329* (2013.01); *B65D 2575/3245* (2013.01); *F04B 49/106* (2013.01)

(58) Field of Classification Search
CPC ..... B01L 2300/44; B01L 2300/0609; B01L 2300/105; B65B 1/04; B65B 55/02; B65D 75/327; B65D 2575/3245; B65D 2575/329; F04B 49/106
USPC ..... 422/430
See application file for complete search history.

(56) References Cited

U.S. PATENT DOCUMENTS 5,139,745 A 8/1992 Barr et al.
5,242,660 A 9/1993 Hsei
5,364,591 A 11/1994 Green et al.
5,447,687 A 9/1995 Lewis et al.
5,447,836 A 9/1995 Wolber et al.
5,494,646 A 2/1996 Seymour
5,637,874 A 6/1997 Honzawa et al.
5,645,801 A 7/1997 Bouma et al.
5,730,938 A 3/1998 Carbonari et al.
5,736,388 A 4/1998 Chada et al.
5,814,022 A 9/1998 Antanavich et al.
5,858,693 A 1/1999 Cottingham
5,917,592 A 6/1999 Skiffington
5,989,499 A 11/1999 Catanzariti et al.
6,144,448 A 11/2000 Mitoma
6,189,580 B1 2/2001 Thibault et al.
6,231,815 B1 5/2001 Bainczyk et al.
6,451,258 B1 9/2002 Malmqvist
6,497,845 B1 12/2002 Sacherer
6,555,312 B1 4/2003 Nakayama
6,719,719 B2 4/2004 Carmel et al.
6,818,185 B1 11/2004 Petersen et al.
7,001,719 B2 2/2006 Wicks et al.
7,284,900 B2 10/2007 Mayer
7,794,656 B2 9/2010 Liang et al.
7,854,104 B2 12/2010 Cronin et al.
8,021,343 B2 9/2011 Nalesso et al.
8,124,024 B2 2/2012 Ching et al.
8,231,548 B2 7/2012 Hoenes
8,377,398 B2 2/2013 McDevitt et al.
8,622,231 B2 1/2014 Woolridge
8,829,473 B1 9/2014 Griswold et al.
8,956,570 B2 2/2015 Wilson et al.
9,133,497 B2 9/2015 Frei et al.
9,329,164 B2 5/2016 Babic et al.
9,381,524 B2 7/2016 Bailey et al.
9,388,453 B2 7/2016 Rey et al.
9,481,903 B2 11/2016 Rey et al.
10,351,893 B2 7/2019 Donnelly et al.
2002/0001539 A1 1/2002 DiCesare et al.
2003/0148536 A1 8/2003 Liang et al.
2004/0126783 A1 7/2004 Bortolin et al.
2004/0191863 A1 9/2004 Cheng et al.
2004/0214200 A1 10/2004 Brown et al.
2005/0206895 A1 9/2005 Salmelainen
2005/0227269 A1 10/2005 Lloyd, Jr. et al.
2005/0273869 A1 12/2005 Court et al.
2006/0205085 A1 9/2006 Handique et al.
2006/0257991 A1 11/2006 McDevitt et al.
2007/0003950 A1 1/2007 Shen et al.
2007/0072174 A1 3/2007 Sayler et al.
2007/0202538 A1* 8/2007 Glezer ..... B01L 3/5085 435/7.1
2007/0209957 A1* 9/2007 Glenn ..... B65D 75/32 206/462
2007/0263049 A1 11/2007 Preckel et al.
2008/0003564 A1 1/2008 Chen et al.
2008/0153096 A1 6/2008 Witty et al.
2008/0193946 A1 8/2008 McMillan
2008/0241819 A1 10/2008 Smith
2008/0261294 A1 10/2008 Noda et al.
2008/0272283 A1 11/2008 Feldsine et al.
2008/0286757 A1 11/2008 Gaisford et al.
2009/0129978 A1* 5/2009 Wilson ..... C07H 1/08 422/400
2009/0155768 A1 6/2009 Scholl et al.
2009/0155838 A1 6/2009 Hale
2009/0246750 A1* 10/2009 Lloyd ..... C12Q 1/70 435/2
2010/0028916 A1 2/2010 Ambar et al.
2010/0112549 A1 5/2010 Rey et al.
2010/0157303 A1 6/2010 Ono
2010/0225920 A1 9/2010 Xia et al.
2011/0079525 A1 4/2011 Peck et al.
2011/0143947 A1 6/2011 Chamberlin et al.
2011/0236960 A1 9/2011 Bird et al.
2012/0071342 A1 3/2012 Lochhead et al.
2012/0134975 A1 5/2012 Hyde et al.
2012/0225423 A1 9/2012 Schwoebel et al.
2012/0288866 A1 11/2012 Kozma et al.
2012/0288897 A1 11/2012 Ching et al.
2014/0272928 A1 9/2014 Rey et al.
2015/0104787 A1 4/2015 Rey et al.
2015/0132795 A1 5/2015 Griswold et al.
2015/0218613 A1 8/2015 de Forest et al.
2016/0053293 A1* 2/2016 Broder ..... C12M 23/12 435/34
2016/0245836 A1 8/2016 Ochranek et al.
2016/0281179 A1 9/2016 Rey et al.
2016/0281180 A1 9/2016 Rey et al.
2017/0096697 A1* 4/2017 Donnelly ..... B01L 3/52
2017/0152576 A1 6/2017 Rey et al.
2017/0224435 A1 8/2017 Godfrey et al.
2017/0233783 A1 8/2017 de Forest et al.
2019/0194765 A1 6/2019 Rey et al.
2019/0204349 A1 7/2019 Ariyoshi et al.
2019/0316168 A1 10/2019 Donnelly et al.

FOREIGN PATENT DOCUMENTS

EP 0274527 7/1987
EP 0168933 4/1993
WO WO 1987/006706 11/1987
WO WO 1995/007457 3/1995
WO WO-9600898 A1 * 1/1996 ..... G01N 33/4905
WO 2001028683 A1 4/2001
WO WO 2001/28683 * 4/2001
WO WO 2005/085855 9/2005
WO WO 2006/075996 7/2006
WO WO 2007/115378 10/2007
WO WO 2010/096584 8/2010
WO 2013173524 A2 11/2013
WO 2013192396 A1 12/2013
WO WO-2013192396 A1 * 12/2013 ..... B01L 3/502
WO WO-2014085852 A1 * 6/2014 ..... B01L 3/523

OTHER PUBLICATIONS

NucliSENS EasyQ MRSA Assay, 510(k) Summary, bioMerieux, Inc., Sep. 20, 2010, 23 pages.
International Search Report and Written Opinion dated Jul. 30, 2018 in corresponding PCT/EP2018/063464 filed on May 23, 2018, pp. 1-13.

* cited by examiner

PACKAGING FOR A MOLECULAR DIAGNOSTIC CARTRIDGE

CROSS-REFERENCE TO RELATED APPLICATIONS

This application claims benefit of priority to U.S. Provisional Application Ser. No. 62/510,013, entitled "Packaging for a Molecular Diagnostic Cartridge," filed May 23, 2017, the disclosure of which is incorporated herein by reference in its entirety.

BACKGROUND

The embodiments described herein relate to package assemblies that facilitate long-term storage (e.g., six months or more) of molecular diagnostic cartridges and devices. Specifically, the embodiments described herein contain a compartment suitable for maintaining a "wet" or liquid reagent and a second separate compartment suitable for maintaining a "dry" reagent (e.g., a reagent that is a solid form or powder form).

Package assemblies suitable for use with environmentally sensitive products, such as medical devices, diagnostic cartridges, reagent containers, or drug compositions employ various mechanisms to provide the package interior, and the contents therein, with a sterile and stable storage environment. In addition to providing a sterile and stable storage environment, some known packaging systems and methods include mechanisms to control the moisture within the packaging. For example, some known systems and methods of packaging include removing oxygen from the packaging before sterilizing the contents of the package (e.g., using methods such as radiation, ethylene oxide, or other sterilization methods). Other known systems include pouches that employ gas permeable compartments that allow the transfer of gasses within the package between components before and during sterilization. Such known systems can include, for example, a desiccant packet that can absorb moisture within the entire package. Other known systems employ sealed reagent containers or "blister packs" to isolate the reagents and/or the sample until delivery of the reagents is desired.

Known packaging solutions, however, do not accommodate reagent cartridges or other components that include both a dry portion (e.g., a lyophilized reagent) and a wet portion (e.g., a liquid reagent). Thus, with such reagent cartridges and systems, known packaging solutions are not sufficient to provide a low enough moisture vapor transmission rate sufficient to support long term storage (e.g., a minimum of a six-month shelf life). Moreover, some reagent cartridges include carefully metered amounts of both dry and wet reagents. In such systems, the inclusion of a desiccant can undesirably act upon the wet reagent, thereby reducing the amount of the wet reagent (by adsorption). Thus, known systems for moisture control may not suitable for reagent cartridges or other components that include both a dry portion and a wet portion. Moreover, known packaging systems often do not accommodate long-term storage after exposure to a variety of different environmental conditions (e.g., reduced ambient pressure encountered during shipment by air, extreme heat during storage, or the like).

Thus, a need exists for improved packaging assemblies and methods for storing diagnostic cartridges that contain wet reagents and dry reagents. In particular, a need exists for improved structures and methods for sealing medical devices, diagnostic cartridges, and wet/dry reagent packages within such assemblies. A need exists for improved apparatus and methods for efficient storage and transfer of reagents and molecular diagnostic cartridges.

SUMMARY

Package assemblies for storing diagnostic cartridges or storing wet/dry reagents are described herein. In some embodiments, an apparatus includes a tray member defining a first volume and a second volume, and a cover member coupled to the tray member covering the first volume and the second volume. The tray member includes a central portion that separates the first volume from the second volume. The first volume is configured to receive a desiccant package and a sample container containing a first reagent. The first reagent has a solid form. The second volume is configured to receive a reagent module containing a second reagent. The second reagent has a liquid form. The cover member and the central portion of the tray member are configured to isolate the first volume from the second volume.

DETAILED DESCRIPTION

Figure 1:
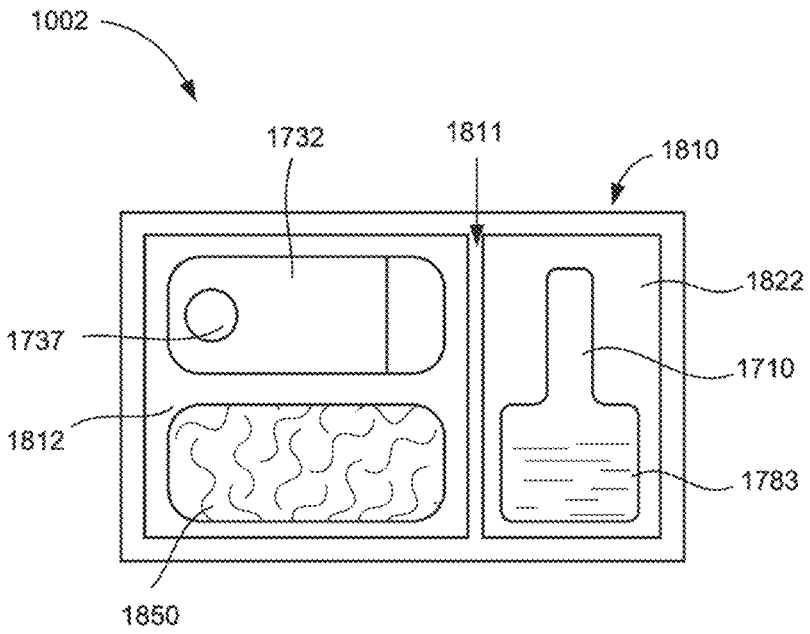
FIG. 1 is a schematic illustration of a packaging assembly according to an embodiment, showing a top view of a tray member of the packaging assembly.

Package assemblies for storing diagnostic cartridges or storing wet/dry reagents are described herein. In some embodiments, an apparatus includes a tray member defining a first volume and a second volume and a cover member coupled to the tray member covering the first volume and the second volume. The tray member includes a central portion that separates the first volume from the second volume. The first volume is configured to receive a desiccant package and a sample container containing a first reagent that has a solid form. The second volume is configured to receive a reagent module containing a second reagent that has a liquid form. The cover member and the central portion of the tray member are configured to isolate the first volume from the second volume.

In some embodiments, an apparatus includes a tray member, a sample container, a desiccant packet, a reagent module, and a cover member. The tray member defines a first volume and a second volume, and includes a central portion that separates the first volume from the second volume. The sample container is disposed within the first volume and contains a first reagent. The first reagent is in a solid form. The desiccant packet is disposed within the first volume. The reagent module is disposed within the second volume and contains a second reagent. The second reagent is in a liquid form. The cover member is coupled to the tray member and covers the first volume and the second volume. The cover member and the tray member are configured such that an expected total moisture ingress into the first volume after 180 days, when the tray member is maintained at a temperature of up to 40° C. and a relative humidity of up to 75 percent, is less than an adsorption capacity of the desiccant packet.

Methods of packaging diagnostic cartridges or assemblies containing both wet and dry reagents are described herein. In some embodiments, a method includes placing a sample container and a desiccant packet into a first volume that is defined by a tray member. The sample container contains a first reagent that is in a solid form. The method further includes placing a reagent module into a second volume that is defined by the tray member. A central portion of the tray member separates the first volume and the second volume. The reagent module contains a second reagent that is in a liquid form. The method further includes heat sealing a cover member to the tray member about the first volume and the second volume. The heat sealing is performed at a temperature of between about 163° C. (325° F.) and about 360° C. (340° F.), a pressure of at least 480 kPa (70 psi), and a time of at least two seconds.

In some embodiments, a packaging assembly (including any of the packaging assemblies described herein) can be configured for long term storage of the reagents, containers and components stored therein. For example, any of the packaging assemblies described herein can be configured to maintain the contents therein for a period of at least six months without degradation of the contents. For example, any of the packaging assemblies described herein can be configured to maintain the contents therein for a period of at least one year without degradation of the contents.

In some embodiments, a packaging assembly (including any of the packaging assemblies described herein) can include a tray member, and a desiccant packet. The packaging assembly is configured such that an expected total moisture ingress into the tray member after 180 days when the tray member is maintained at a temperature of up to 40° C. and a relative humidity of up to 75 percent is less than an adsorption capacity of the desiccant packet.

As used herein, the singular forms "a," "an", and "the" include plural referents unless the context clearly dictates otherwise. Thus, for example, the term "a member" is intended to mean a single member or a combination of members, "a material" is intended to mean one or more materials, or a combination thereof.

As used herein, a term referring to multiple components or portions thereof is intended to refer to a first component or a first portion thereof, and/or a second component or a second portion thereof, unless the context clearly dictates otherwise. Thus, for example, the term "reagents" is intended to refer to a "first reagent" and/or a "second reagent."

As used herein, a "set" can refer to multiple features or a singular feature with multiple parts. For example, when referring to set of walls, the set of walls can be considered as one wall with distinct portions, or the set of walls can be considered as multiple walls.

As used herein, the terms "about" and "approximately" when used in connection with a referenced numeric indication means the referenced numeric indication plus or minus 10 percent of the value stated. For example, about 0.5 would include 0.45 and 0.55, about 10 would include 9 to 11, about 1000 would include 900 to 1100.

The term "fluid-tight" is understood to encompass both a hermetic seal (i.e., a seal that is gas-impervious) as well as a seal that is liquid-impervious. The term "substantially" when used in connection with "fluid-tight," "gas-impervious," and/or "liquid-impervious" is intended to convey that, while total fluid imperviousness is desirable, some minimal leakage due to manufacturing tolerances, or other practical considerations (such as, for example, the pressure applied to the seal and/or within the fluid), can occur even in a "substantially fluid-tight" seal. Thus, a "substantially fluid-tight" seal includes a seal that prevents the passage of a fluid (including gases, liquids and/or slurries) therethrough when the seal is maintained at a constant position and at fluid pressures of less than about 5 psig. Similarly, a "substantially liquid-tight" seal includes a seal that prevents the passage of a liquid (e.g., a liquid sample or reagent) therethrough when the seal is maintained at a constant position and is exposed to liquid pressures of less than about 5 psig.

Figure 2:
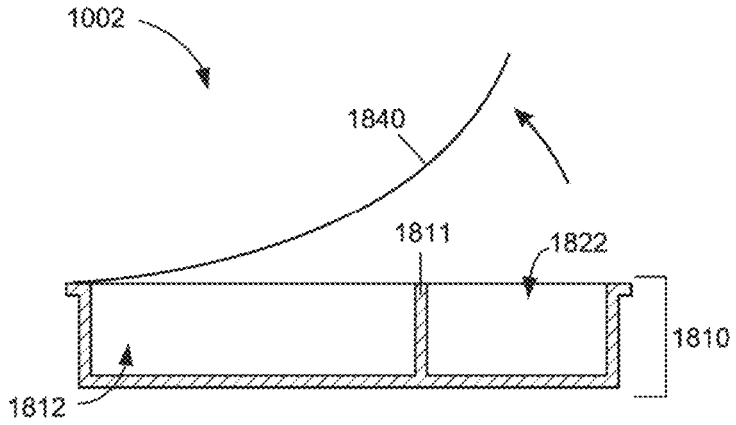
FIG. 2 is a schematic illustration of the packaging assembly shown in FIG. 1, showing a side view of the tray member of the packaging assembly as a cover member is being removed from the tray member.

FIGS. 1 and 2 show schematic illustrations of a packaging assembly 1002, according to an embodiment. The packaging assembly 1002 is used to contain components of a molecular diagnostic test system for storage, transportation, and appropriate handling of the contents. For example, the packaging assembly 1002 can contain a reagent module, a reagent container, a sample container, a test cartridge, or the like. The packaging assembly 1002 and the components therein can be used with and manipulated by any of the instruments and/or any of the components described herein and in U.S. Pat. No. 9,481,903, entitled "Systems and Methods for Detection of Cells using Engineered Transduction Particles," ("the '903 patent"), which is incorporated herein by reference in its entirety. In this manner, the packaging assembly 1002 and any of the packaging assemblies described herein can be used to detect and/or identify target cells (e.g., bacteria) within a sample according to any of the methods described herein or in the '903 patent.

The packaging assembly 1002 includes a tray member 1810 and a cover member 1840. FIG. 1 shows a top view of a tray member 1810 (without the cover member 1840, so that the contents within and the structure of the tray member 1810 can be seen). FIG. 2 shows the cover member 1840 being removed from the top surface of the tray member 1810. As shown in FIG. 1, the tray member 1810 defines a first volume 1812 and a second volume 1822. The first volume 1812 and the second volume 1822 are separated by a central portion 1811 of the tray member 1810. The central portion 1811 can include any suitable structure that separates and/or isolates the first volume 1812 from the second volume 1822. For example, as shown, in some embodiments the central portion 1811 can include wall having a first side that forms a portion of the boundary of the first volume 1812 and a second side that forms a portion of the boundary of the second volume 1822. In other embodiments, the central portion 1811 can include a wall that does not extend the length of a side of either the first volume 1812 or the second volume 1822. In yet other embodiments, the central portion 1811 can include a set of walls that define one more cavities, and that separate and/or isolate the first volume 1812 from the second volume 1822.

The first volume 1812 is configured to include, contain, or store a sample container 1732 and a desiccant packet 1850. The sample container 1732 contains a first reagent 1737. The tray member 1810 can include one or more walls that define a shape of the first volume 1812 to receive and/or retain the sample container 1732. The first reagent 1737 is a dry reagent that is in a solid form. The first reagent 1737 can be a powder, film, bead, or the like. For example, the first reagent 1737 can be a bead that contains an antibiotic. The antibiotic can be any one of a Beta-lactam, an extended-spectrum beta-lactam, an Aminoglycoside, an Ansamycin, a Carbacephem, a Carbapenem, any generation of Cephalosporins, a Glycopeptide, a Lincosamide, a Lipopeptide, a Macrolide, a Monobactam, a Nitrofuran, an Oxazolidonone, a Penicillin, a Polypeptide, a Quinolone, a Fluoroquinolone, a Sulfonamide, a Tetracycline, a mycobacterial antibiotic, a Chloramphenicol, or a Mupirocin. In other embodiments, the first reagent 1737 can be a reagent that inhibits or enhances the viability or growth of a cell. In other embodiments, the first reagent 1737 can be a reagent that is unstable in liquid form and stable in dry form.

The desiccant packet 1850 can contain any non-toxic, FDA-approved, adsorbent material such as Silica Gel or clay. One example of a suitable desiccant packet is a MiniPax® Sorbent packet. The desiccant packet 1850 provides moisture protection for the first reagent 1737 by adsorbing any moisture within the first volume 1812. In this manner, the desiccant packet 1850 and the first volume 1812 produce an environment for long term storage of the sample container 1732 including the first reagent 1737. Similarly stated, the desiccant packet 1850 and the tray member 1810 eliminate and/or reduce the amount of moisture to which the first reagent is exposed, thereby maintaining the viability and properties of the first reagent 1737 during long term storage (e.g., up to at least six months).

The desiccant packet 1850 can be of any shape or size. For example, in some embodiments, the desiccant packet 1850 can be a flat square or a cylinder, or the desiccant packet 1850 can be incorporated into sheets or film layers. In some embodiments, the desiccant packet 1850 can have a moisture adsorption capacity of between about 15 percent and about 20 percent of the mass of the desiccant packet 1850. Accordingly, the desiccant packet 1850 (and the first volume 1812) can be sized to provide the desired total level of moisture adsorption over the desired duration of product storage. For example, in some embodiments, the desiccant packet 1850 can have a mass of between about 2 grams and about 5 grams. In other embodiments, the desiccant packet 1850 can have a mass of between about 3 grams and about 3.5 grams.

The desiccant packet 1850 can be arranged in any manner within the first volume 1812. For example, FIG. 1 shows the desiccant packet 1850 in a position beside (or offset from) the sample container 1732. However, in other embodiments, the desiccant packet 1850 can be placed on top of or below the sample container 1732. In yet other embodiments, the desiccant packet 1850 surrounds or encloses at least a portion of the sample container 1732.

The second volume 1822 of the tray member 1810 is configured to contain a reagent module 1710 that contains a second (liquid) reagent 1783. The reagent module can be any suitable reagent module or reagent container, such as for example, any of the reagent modules described in U.S. Pat. No. 9,481,903, entitled "Systems and Methods for Detection of Cells using Engineered Transduction Particles," and U.S. Pat. No. 9,540,675, entitled "Reagent Cartridge and Methods for Detection of Cells,", each of which is incorporated herein by reference in its entirety. The reagent module 1710 can be shaped and sized to be disposed substantially inside the second volume 1822. Similarly stated, the tray member 1810 can include one or more walls that define a shape of the second volume 1822 to receive and/or retain the reagent module.

The liquid reagent 1783 can be any suitable reagent. For example, in some embodiments, the liquid reagent 1783 can be any one of a transduction particle solution formulated to cause a target cell within a sample to produce a reporter molecule associated with a luminescence reaction or a reagent composition formulated to catalyze a luminescence reaction. For example, the reporter molecule can be luciferase and the liquid reagent 1783 can be an aldehyde reagent formulated to trigger, initiate and/or catalyze a luminescence reaction that can be detected by the production of the signal. Said another way, the liquid reagent 1783 can be a liquid formulation containing protein or nucleic acid molecules formulated to cause a target cell to produce a reporter molecule or a molecule formulated to cause the reporter molecule to produce a detectable signal. In some embodiments, the liquid reagent 1783 can include a 6-carbon aldehyde (hexanal), a 13-carbon aldehyde (tridecanal) and/or a 14-carbon aldehyde (tetradecanal), inclusive of all the varying carbon chain length aldehydes therebetween. In other embodiments, the liquid reagent 1783 can be a fatty aldehyde.

FIG. 2 is a schematic illustration of the packaging assembly 1002, showing a side view of the tray member 1810 as a cover member 1840 is being removed from the tray member 1810 when the packaging assembly 1002 is transitioned from a first configuration (cover member 1840 attached) to a second configuration (cover member 1840 removed). Thus, when in the first configuration, the packaging assembly 1002, the cover member 1840 is coupled to the tray member 1810 covering the first volume 1812 and the second volume 1822. Similarly stated, the cover member 1840 and the tray member 1810 surround and isolate the first volume 1812 from the second volume 1822. In some embodiments, as described herein, there can be a bond (e.g., an adhesive bond, a heat-sealed bond, or the like) between the cover member 1840 and the central portion 1811 of the tray member 1810 that isolates the first volume 1812 from the second volume 1822. In this manner, the moisture adsorption produced by the desiccant packet 1850 within the first volume 1812 does not affect the reagent module 1710 and/or the second reagent 1783 within the second volume 1822. For example, in some embodiments, the reagent module 1710 can include a volume of the second (liquid) reagent 1783 that is within a predetermined amount. By maintaining isolation between the first volume 1812 and the second volume 1822, inadvertent adsorption of the second (liquid) reagent 1783 by the desiccant packet 1850 can be eliminated or minimized.

In some embodiments, when the packaging assembly 1002 is maintained in an environment having a temperature of up to 40° C. and a relative humidity of up to 75 percent, the cover member 1840, the tray member 1810, and the desiccant packet 1850 are collectively configured to provide an expected total moisture ingress into the first volume 1812, after 180 days, of less than an adsorption capacity of the desiccant packet 1850. For example, in some embodiments, the cover member 1840 and the tray member 1810 are collectively configured to provide an expected total moisture ingress into the first volume 1812, after 180 days, of less than about 0.3 grams. In such embodiments, if the adsorption capacity of the desiccant packet 1850 is at least 0.3 grams, then the moisture ingress into the first volume 1812 will have limited (if any) effect on the first (dry) reagent 1737. Moreover, because the first volume 1812 is isolated from the second volume 1822, the adsorption capacity of the desiccant packet 1850 is not compromised (or reduced) by any moisture within the second volume 1822, and the amount of the liquid reagent 1783 is also not compromised (or reduced) by the desiccant packet 1850. In some embodiments, the cover member 1840, the tray member 1810, and the desiccant packet 1850 are collectively configured to provide an expected total moisture ingress into the first volume 1812, after 180 days, of less than about half of the adsorption capacity of the desiccant packet 1850. As stated above, in some embodiments, the adsorption capacity of the desiccant packet 1850 is between 15 percent and 20 percent of a mass of the desiccant packet 1850. Thus, in some embodiments, a desiccant packet having a mass of about 3 grams provides an adsorption capacity of about 0.6 grams. Thus, in those embodiments in which the cover member 1840 and the tray member 1810 are collectively configured to provide an expected total moisture ingress into the first volume 1812, after 180 days, of less than about 0.3 grams, then the packaging system 1002 can have a long-term storage life of at least 180 days (with a safety margin of 50 percent). In other embodiments, the cover member 1840, the tray member 1810, and the desiccant packet 1850 are collectively configured to provide an expected total moisture ingress that allows for a long-term storage life of at least one year.

The cover member 1840 and the tray member 1810 can be constructed from any suitable material (or materials) that provides the environmental stability (e.g., that limits the moisture ingress) as described herein. For example, in some embodiments, the cover member 1840 is constructed from a polyolefin material, such as Teknilid WPSPPE. This material can be bonded to the top portion of the tray member 1810 by any of the methods described herein.

In some embodiments, the tray member 1810 can be constructed from a cyclic olefin copolymer film, such as Tekniflex COC P12P-1, ACLAR® fluoropolymer films, or any other polymer film that can withstand high temperatures. In some embodiments, the tray member 1810 can be monolithically constructed. For example, the tray member 1810 maybe produced by the following manufacturing methods: injection molding, thermoforming, pressure forming, blow molding, cold forming, die cutting, stamping, extruding, machining, drawing, casting, or laminating. The overall thickness of the tray member 1810 can be any suitable value that, in conjunction with the material from which the tray is constructed, produces the desired environmental stability (e.g., that limits the moisture ingress), as described herein. For example, in some embodiments, the thickness of the tray member 1810 is between about 0.06 mm and about 0.6 mm.

In some embodiments, the tray member 1810 can be constructed from a transparent material so that a user can see through the tray member 1810 to view the internal components contained in the first volume 1812 and/or the second volume 1822. In this manner, a user can read any labels attached to the internal components through the tray member 1810.

Figure 3:
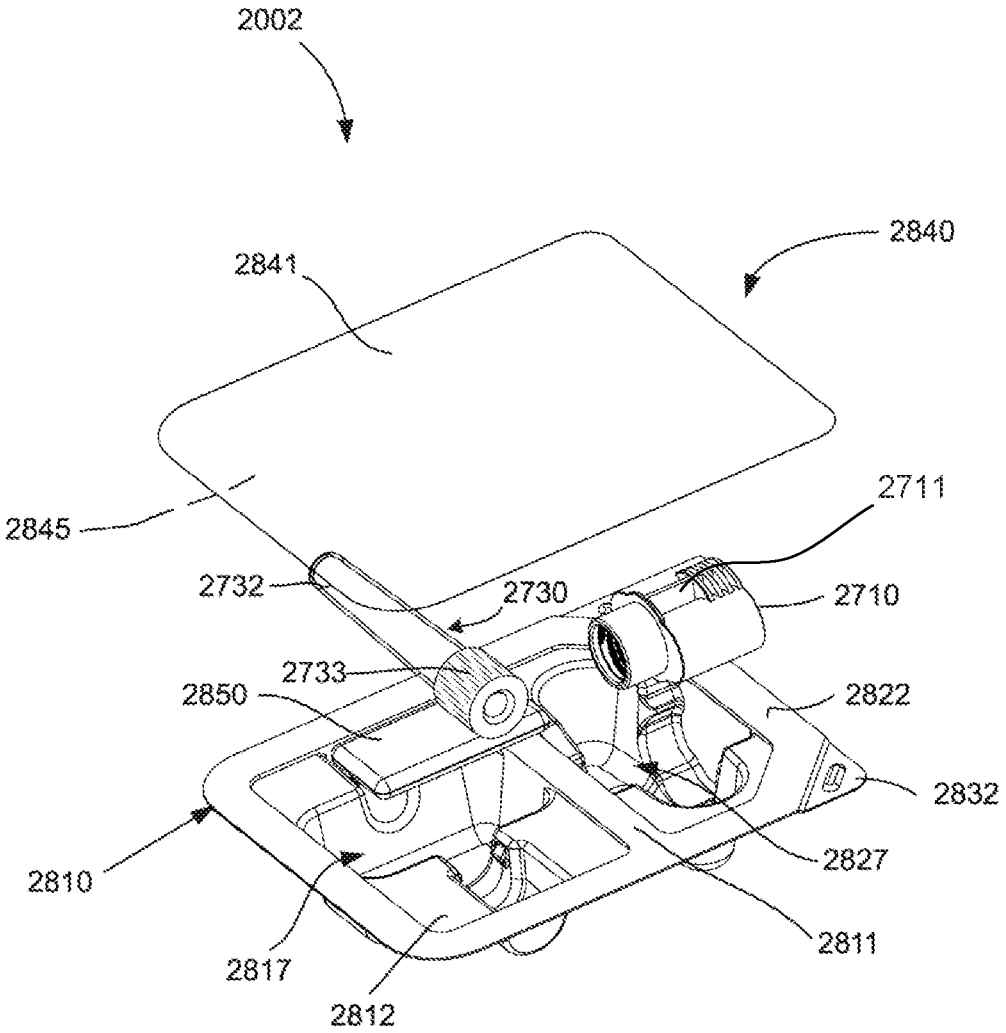
FIG. 3 is an exploded perspective view of a packaging assembly according to an embodiment.

FIGS. 3-13 show a variety of perspective views, cross-sectional views, and photographs of a package assembly 2002 according to an embodiment. FIG. 3 is an exploded perspective view of the package assembly 2002 that is used to contain components of a molecular diagnostic test system for storage, transportation, and appropriate handling of the contents. For example, the package assembly 2002 can contain a reagent module, a reagent container, a sample container, a test cartridge, or the like. The package assembly 2002 and the components therein can be used with and manipulated by any of the instruments and/or any of the components described herein and in U.S. Pat. No. 9,481,903, entitled "Systems and Methods for Detection of Cells using Engineered Transduction Particles," ("the '903 patent"), which is incorporated herein by reference in its entirety. In this manner, the package assembly 2002 and any of the packaging assemblies described herein can be used to detect and/or identify target cells (e.g., bacteria) within a sample according to any of the methods described herein or in the '903 patent.

The package assembly 2002 includes a cover member 2840 and a tray member 2810. As shown in FIG. 3, the tray member 2810 defines a first volume 2812 and a second volume 2822. The first volume 2812 and the second volume 2822 are separated by a central portion 2811 of the tray member 2810. The central portion 2811 can include any suitable structure that separates and/or isolates the first volume 2812 from the second volume 2822. For example, as shown, in some embodiments the central portion 2811 can include wall having a first side that forms a portion of the boundary of the first volume 2812 and a second side that forms a portion of the boundary of the second volume 2822.

In other embodiments, the central portion 2811 can include a wall that does not extend the length of a side of either the first volume 2812 or the second volume 2822. In yet other embodiments, the central portion 2811 can include a set of walls that define one more cavities, and that separate and/or isolate the first volume 2812 from the second volume 2822.

The first volume 2812 is configured to include, contain, or store a sample tube assembly 2730 and a desiccant packet 2850. The sample tube assembly 2730 (also referred to as an assay container assembly) contains a sample container 2732 (also referred to as a reaction tube) and a removable cap 2733. The sample container 2732 contains a first reagent (not shown). The first reagent is a dry reagent that is in a solid form. The first reagent can be a powder, film, bead, or the like. For example, the first reagent can be a bead that contains an antibiotic. The antibiotic can be any one of a Beta-lactam, an extended-spectrum beta-lactam, an Aminoglycoside, an Ansamycin, a Carbacephem, a Carbapenem, any generation of Cephalosporins, a Glycopeptide, a Lincosamide, a Lipopeptide, a Macrolide, a Monobactam, a Nitrofuran, an Oxazolidonone, a Penicillin, a Polypeptide, a Quinolone, a Fluoroquinolone, a Sulfonamide, a Tetracycline, a mycobacterial antibiotic, a Chloramphenicol, or a Mupirocin. In other embodiments, the first reagent can be a reagent that inhibits or enhances the viability or growth of a cell. In other embodiments, the first reagent can be a reagent that is unstable in liquid form and stable in dry form.

Figure 6:
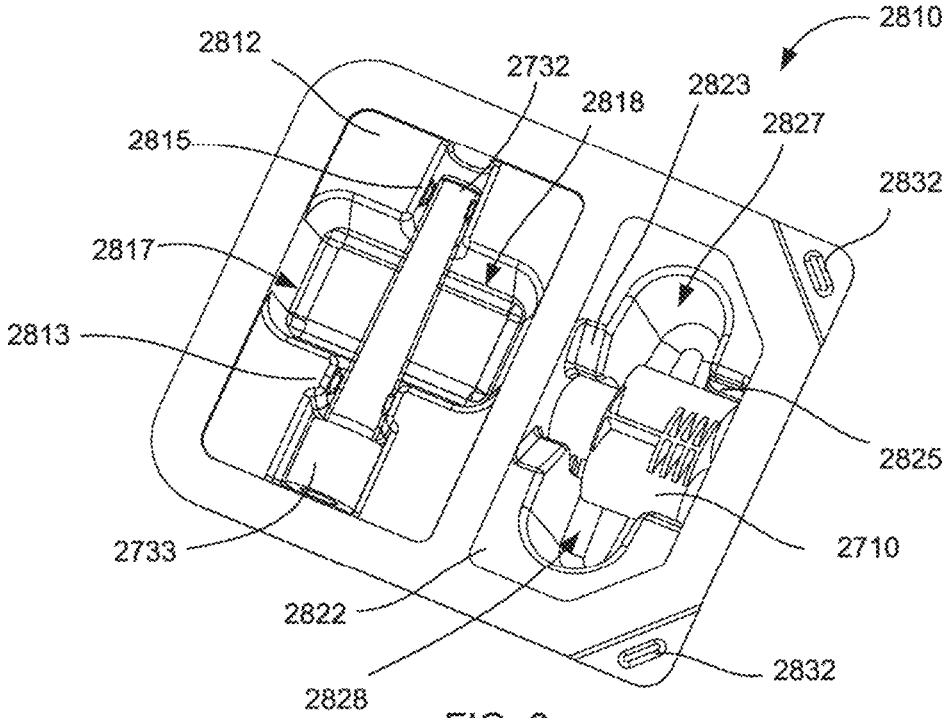
FIG. 6 is a top perspective view of the packaging assembly shown in FIG. 3, showing the tray member including a sample tube assembly contained in a first volume and a reagent module contained in a second volume.
Figure 7:
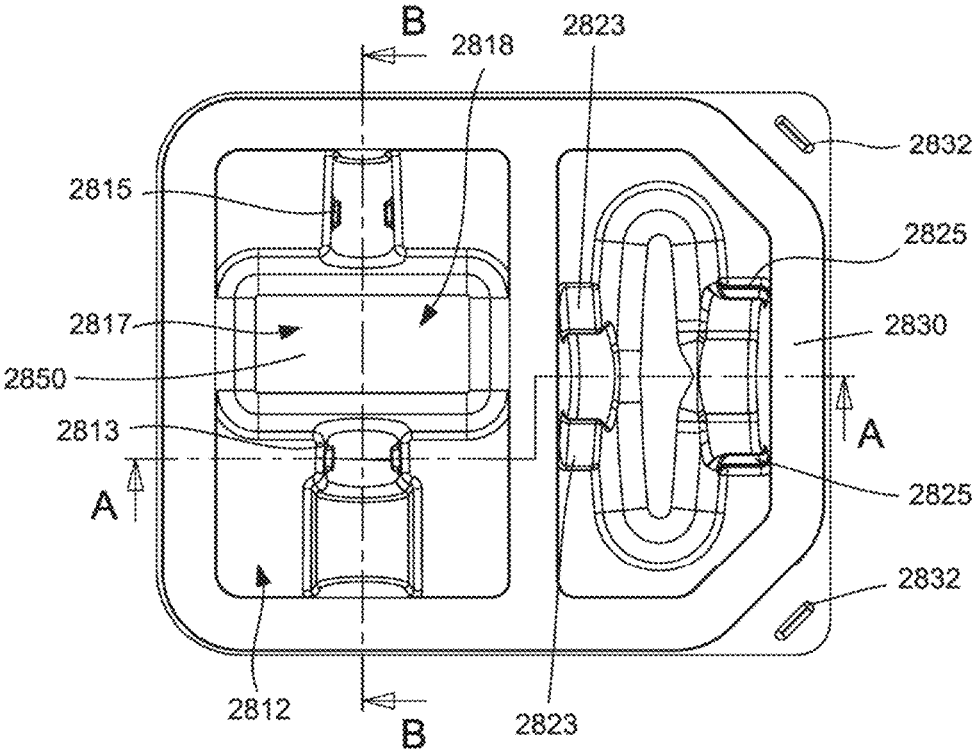
FIG. 7 is a top view of a tray member of the packaging assembly shown in FIG. 3.
Figure 8:
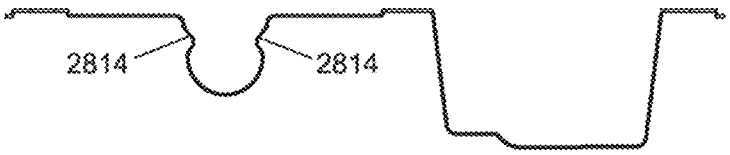
FIG. 8 is a side cross-sectional view of the tray member shown in FIG. 7, taken along the line A-A in FIG. 7.
Figure 9:
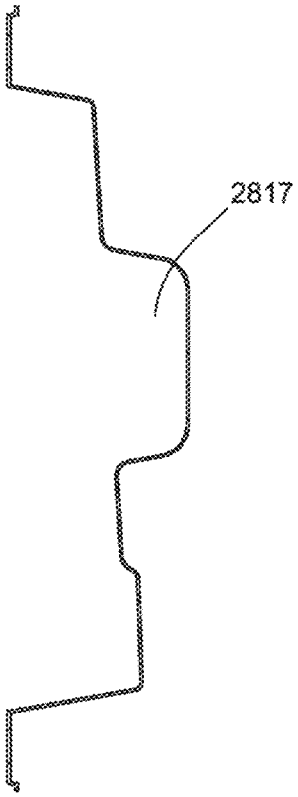
FIG. 9 is a side cross-sectional view of the tray member shown in FIG. 7, taken along the line B-B in FIG. 7.
Figure 10:
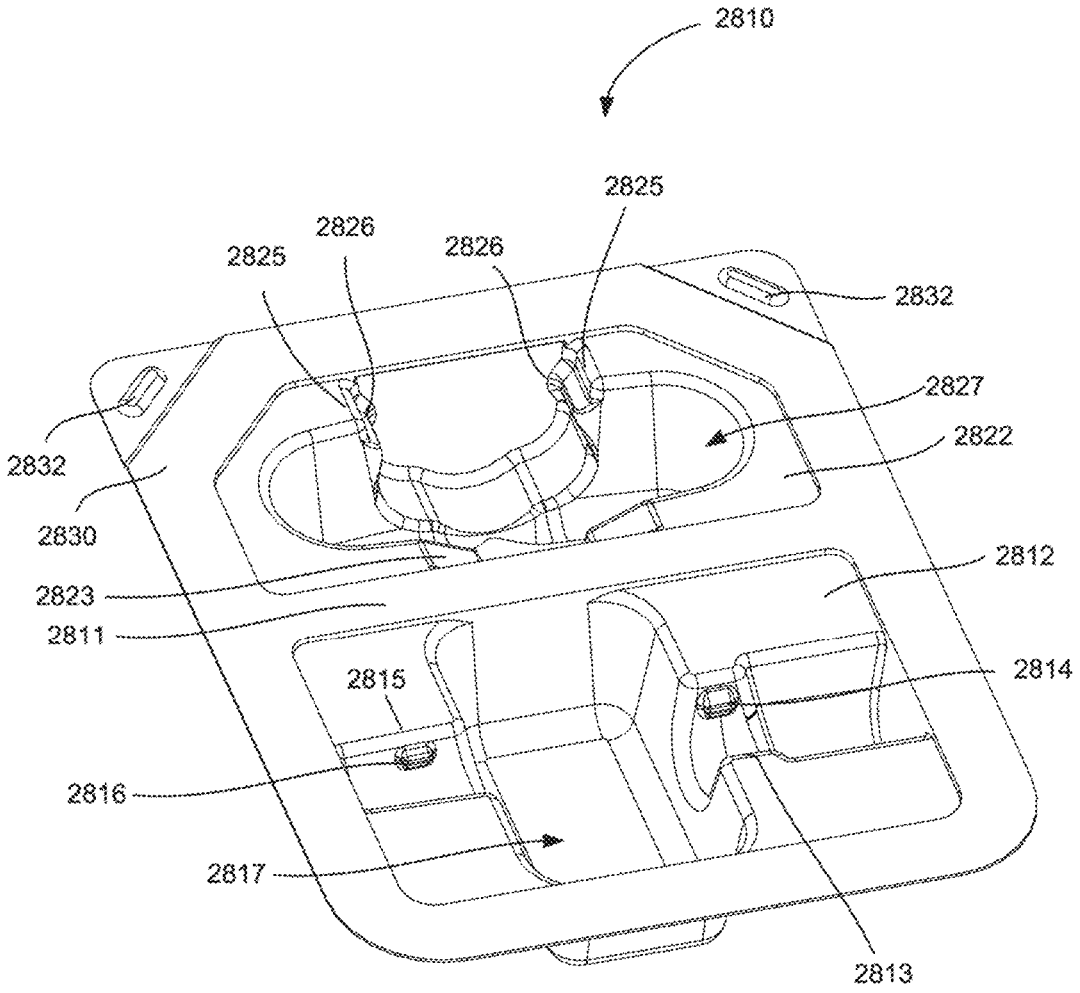
FIG. 10 is a top perspective view of the tray member of the packaging assembly shown in FIG. 3.

The tray member 2810 can include one or more walls that define a shape of the first volume 2812 to receive and/or retain the sample container 2732. Thus, to securely hold the sample container 2732 in place, the first volume 2812 includes a first retainer 2813 and a second retainer 2815. The retainers 2813, 2815 hold the sample container 2732 in a fixed position within the first volume 2812. The tray member 2810 can include one or more walls that define the retainers. As shown in FIG. 10, the retainers 2813, 2815 each include a pair of protrusions 2814 and 2816, respectively (see also FIG. 8 for protrusions 2814 in the first retainer 2813). These protrusions engage the sample container 2732 when the sample container 2732 is secured in a fixed position within the first volume 2812, as shown in FIG. 6.

Figure 4:
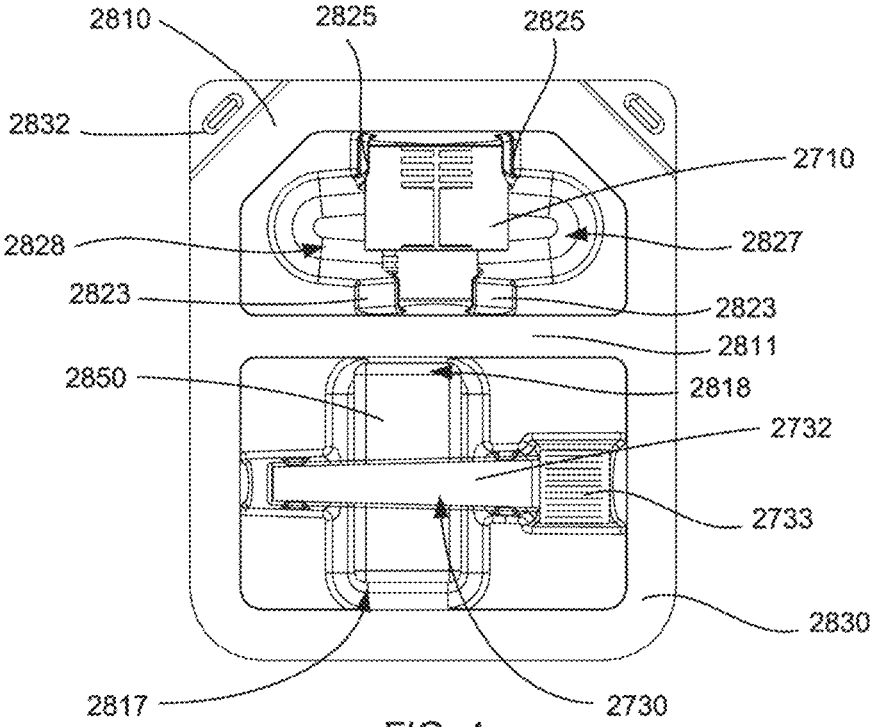
FIG. 4 is a top view of the packaging assembly shown in FIG. 3, showing a tray member, a sample tube assembly, a desiccant packet, and a reagent module.
Figure 5:
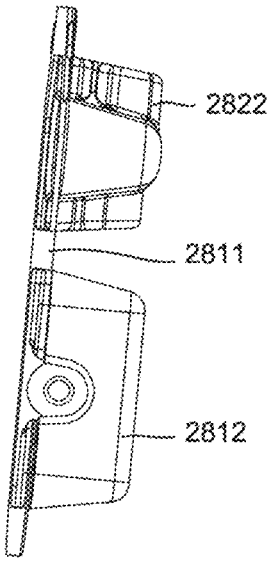
FIG. 5 is a side view of the packaging assembly shown in FIG. 3.

A portion of the tray member 2810 within the first volume 2812 is spaced apart from the sample container 2732 when the sample container 2732 is in a fixed position to define a removal volume 2817. As shown in FIGS. 4 and 10, the removal volume 2817 is a space within the first volume 2812 surrounding the sample container 2732. The removal volume 2817 is a space within the first volume 2812 between the sample container 2732 and the tray within which a user can insert an object (e.g., their fingers, a tool, or the like) to remove the sample container 2732 from within the first volume 2812. When the sample container 2732 is fixed within the first volume 2812, as shown in FIG. 4, the tray member 2810 defines a first removal volume 2817 and a second removal volume 2818. A user can place their fingers or another object within the removal volume 2817 and/or the removal volume 2818 to grasp the sample container 2732 and remove the sample container 2732 from the first volume 2812.

The desiccant packet 2850 can contain any non-toxic, FDA-approved, adsorbent material such as a molecular sieve, a silica gel, an activated alumina, or clay. One example of a suitable desiccant packet is a MiniPax® Sorbent packet. The desiccant packet 2850 provides moisture protection for the first reagent by adsorbing any moisture within the first volume 2812. In this manner, the desiccant packet 2850 and the first volume 2812 produce an environment for long term storage of the sample container 2732 including the first reagent. Similarly stated, the desiccant packet 2850 and the tray member 2810 eliminate and/or reduce the amount of moisture to which the first reagent is exposed, thereby maintaining the viability and properties of the first reagent during long term storage (e.g., up to at least six months).

The desiccant packet 2850 can be of any shape or size. For example, in some embodiments, the desiccant packet 2850 can be a flat square or a cylinder, or the desiccant packet 2850 can be incorporated into sheets or film layers. In some embodiments, the desiccant packet 2850 can have a moisture adsorption capacity of between about 15 percent and about 20 percent of the mass of the desiccant packet 2850. Accordingly, the desiccant packet 2850 (and the first volume 2812) can be sized to provide the desired total level of moisture adsorption over the desired duration of product storage. For example, in some embodiments, the desiccant packet 2850 can have a mass of between about 2 grams and about 5 grams. In other embodiments, the desiccant packet 2850 can have a mass of between about 3 grams and about 3.5 grams.

Figure 23:
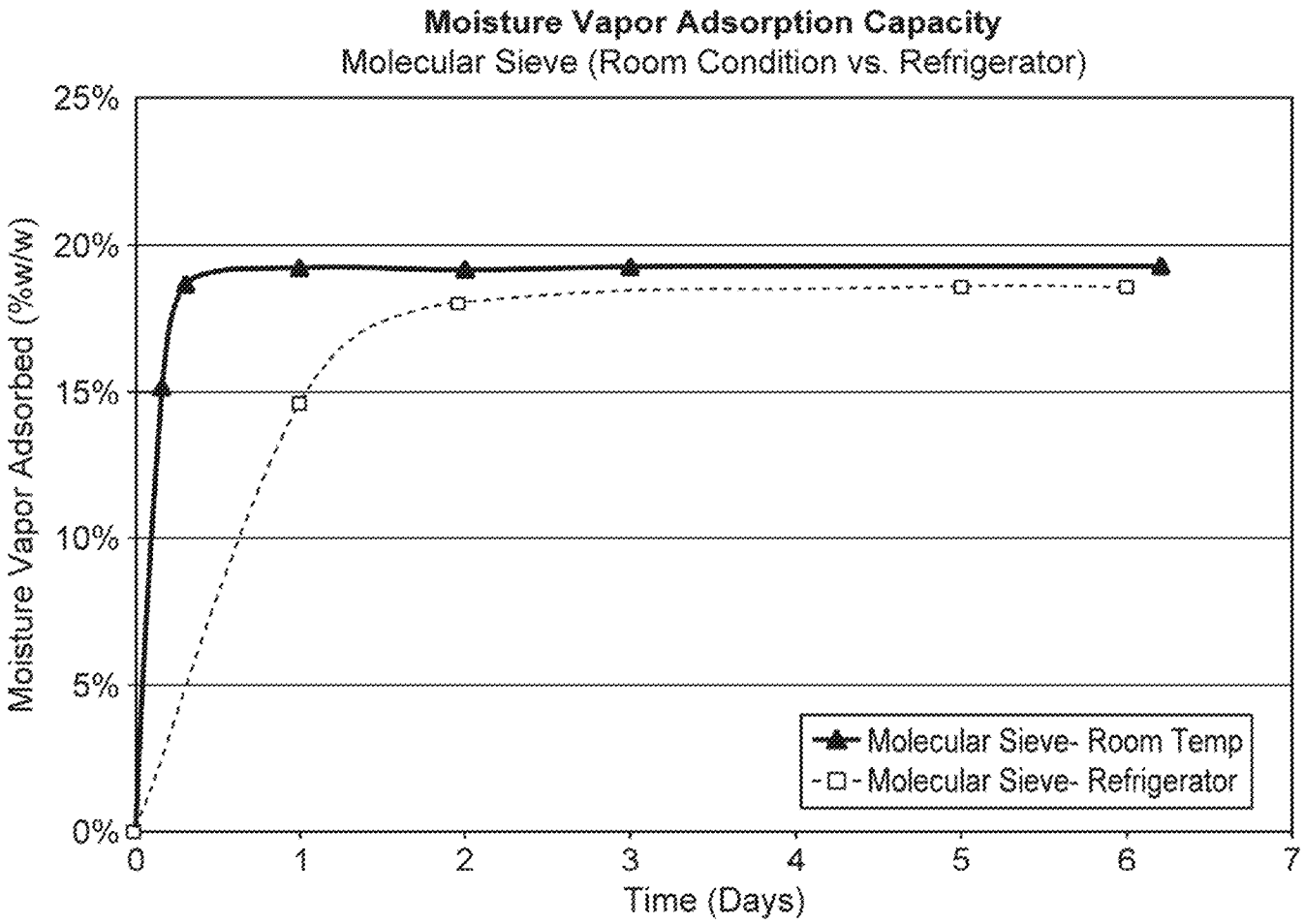
FIG. 23 is a graph showing the moisture vapor adsorption capacity of a desiccant packet included within a packaging assembly, according to an embodiment.

FIG. 23 is a graph that shows the moisture vapor adsorption capacity for a desiccant packet according to an embodiment that is constructed from and/or includes a molecular sieve. The chart shows the amount of moisture absorbed (in terms of the percentage of the desiccant weight) as a function of time. As shown in this graph, the molecular sieve desiccant packet has an adsorption capacity of between about 15 percent and about 20 percent of the weight of the desiccant packet. The total amount of moisture that can be adsorbed is therefore the weight of the desiccant multiplied by the moisture vapor adsorption capacity.

The desiccant packet 2850 can be arranged in any manner within the first volume 2812. As shown in FIG. 3, the desiccant packet 2850 within package assembly 2002 is positioned below the sample tube assembly 2730. However, in other embodiments, the desiccant packet 2850 can be placed in a position parallel to and offset from the sample tube assembly 2730. In other embodiments, the desiccant packet 2850 can be placed above the sample tube assembly 2730. In yet other embodiments, the desiccant packet 2850 surrounds or encloses at least a portion of the sample tube assembly 2730. For example, in some embodiments, all or a portion of the desiccant packet 2850 can surround the sample tube assembly 2730, and be within the removal volume 2817 and/or the removal volume 2818.

The second volume 2822 of the tray member 2810 is configured to contain a reagent module 2710 that contains a second (liquid) reagent (not shown). The reagent module 2710 can be any suitable reagent module or reagent container, such as for example, any of the reagent modules described in U.S. Pat. No. 9,481,903, entitled "Systems and Methods for Detection of Cells using Engineered Transduction Particles," and U.S. Pat. No. 9,540,675, entitled "Reagent Cartridge and Methods for Detection of Cells," each of which is incorporated herein by reference in its entirety. As shown in FIG. 3, the reagent module 2710 includes a housing 2711 that can be removably coupled to the sample container 2732. In some embodiments, the housing 2711 can be threadedly coupled to a proximal portion of the sample container 2732. In other embodiments, the housing 2711 and the sample container 2732 can form an interference fit to couple the housing 2711 to the sample container 2732. Thus, as shown, the reagent module 2710 can be stored separately from and/or spaced apart from the sample container 2732. In use, a sample can be placed into the sample container 2732 and then the reagent module 2710 (and housing 2711) can be coupled to the sample container 2732 to complete the desired test. The reagent module 2710 can be shaped and sized to be disposed substantially inside the second volume 2822. Similarly stated, the tray member 2810 can include one or more walls that define a shape of the second volume 2822 to receive and/or retain the reagent module.

The liquid reagent can be any suitable reagent. For example, in some embodiments, the liquid reagent can be any one of a transduction particle formulated to cause a target cell within a sample to produce a reporter molecule associated with a luminescence reaction or a reagent composition formulated to catalyze a luminescence reaction. For example, the reporter molecule can be luciferase and the liquid reagent can be an aldehyde reagent formulated to trigger, initiate and/or catalyze a luminescence reaction that can be detected by the production of the signal. Said another way, the liquid reagent can be a liquid formulation containing protein or nucleic acid molecules formulated to cause a target cell to produce a reporter molecule or a molecule formulated to cause the reporter molecule to produce a detectable signal. In some embodiments, the liquid reagent can include a 6-carbon aldehyde (hexanal), a 13-carbon aldehyde (tridecanal) and/or a 14-carbon aldehyde (tetradecanal), inclusive of all the varying carbon chain length aldehydes therebetween. In other embodiments, the liquid reagent can be a fatty aldehyde.

To securely hold the reagent module 2710 in place, the second volume 2822 includes a first retainer 2823 and a second retainer 2825. The first retainer 2823 and the second retainer 2825 hold the reagent module 2710 in a fixed position within the second volume 2822. The tray member 2810 can include one or more walls that define the first retainer 2823 and the second retainer 2825. As shown in FIG. 10, the first retainer 2823 and the second retainer 2825 each have protrusions. For example, FIG. 10 shows the protrusions 2826, which make up a portion of the second retainer 2825. These protrusions engage the reagent module 2710 when the reagent module 2710 is secured in a fixed position within the second volume 2822, as shown in FIG. 6.

A portion of the tray member 2810 within the second volume 2822 is spaced apart from the reagent module 2710 when the reagent module 2710 is in a fixed position to define a removal volume 2827 and a removal volume 2828. As shown in FIGS. 4 and 10, the removal volume 2827 and the removal volume 2828 are spaces within the second volume 2822 surrounding the reagent module 2710. The removal volumes 2827, 2828 are spaces within the second volume 2822 between the reagent module 2710 and the tray within which a user can insert an object (e.g., their fingers, a tool, or the like) to remove the reagent module 2710 from within the second volume 2822. Specifically, a user can place their fingers or another object within the removal volume 2827 and/or the removal volume 2828 to grasp the reagent module 2710 and remove the reagent module 2710 from the second volume 2822.

The top portion of the tray member 2810 includes a flange 2830, as shown in FIG. 10. The flange 2830 has a flat surface that surrounds the first volume 2812 and the second volume 2822. Moreover, the flange 2830 is coplanar with and/or includes a top surface of the central portion 2811. In this manner, the flange 2830 provides a surface area to which the cover member 2840 can be sealed. Moreover, the flange 2830 (including the top portion of the central portion 2811) has a sufficient width and/or surface area to allow the cover member 2840 to be sealed thereto in a manner that minimizes moisture ingress, bubbling of the seal, or the like.

In some embodiments, the flange 2830 can include one or more "step downs" (or portions that are nonplanar with the sealing area, not shown). Although such step downs can reduce the overall sealing area, the can also provide additional advantages, such as a break between the cover member 2840 and the tray member 2810 that can allow the user to easily peel back the cover member 2840. Moreover, the flange 2830 of the tray member 2810 includes at least one peel protrusion 2832 on the side corner of top surface of the tray member 2810. The peel protrusions 2832 allows a user to grab a corner of the cover member 2840 to peel back the cover member 2840 from the top surface of the tray member 2810 for access to the contents of the package assembly 2002.

Figure 12:
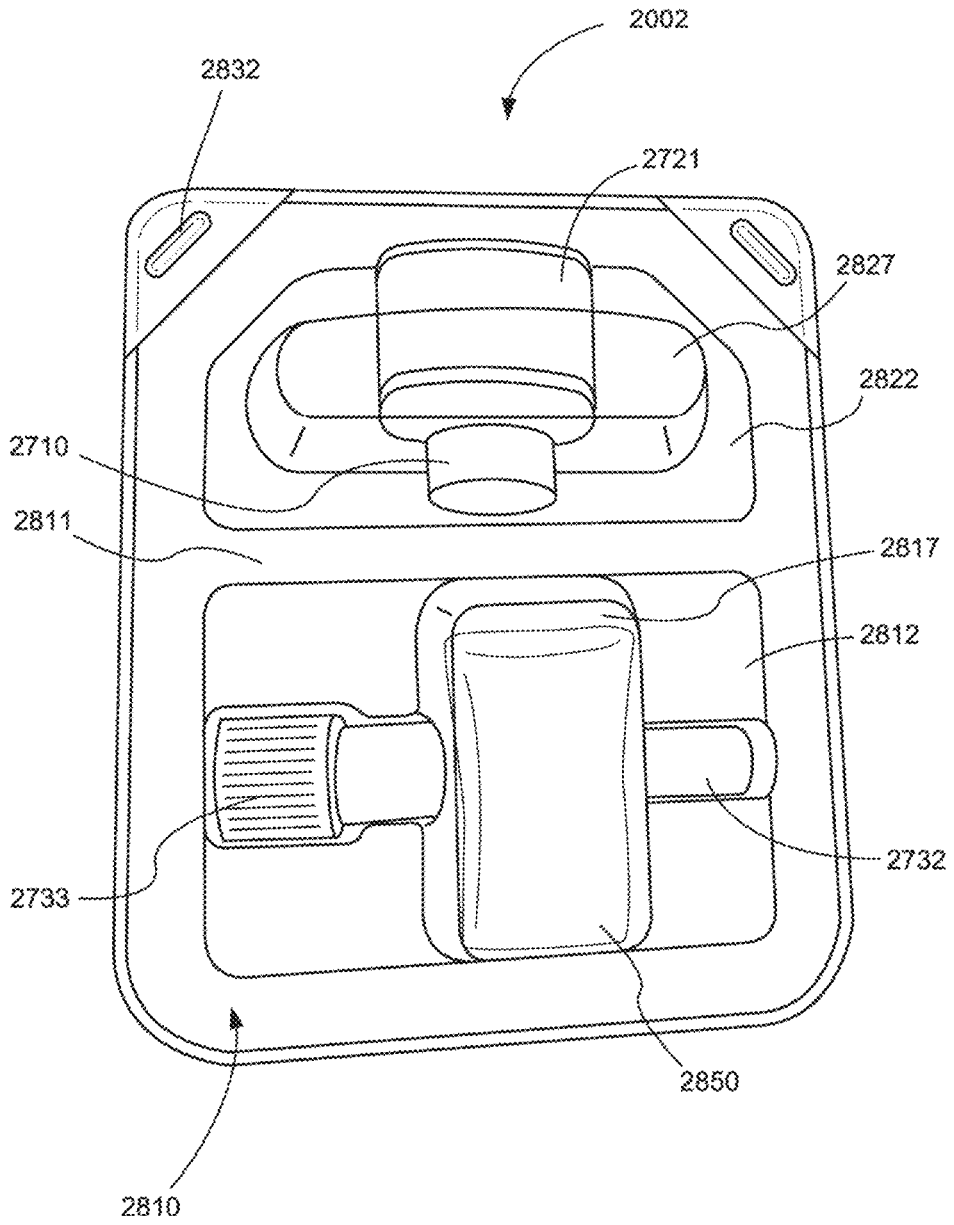
FIG. 12 is a bottom view photograph of the packaging assembly shown in FIG. 3, showing a transparent tray member such that a user can view, through the tray member, a label affixed to a reagent module within a second volume of the packaging assembly.
Figure 13:
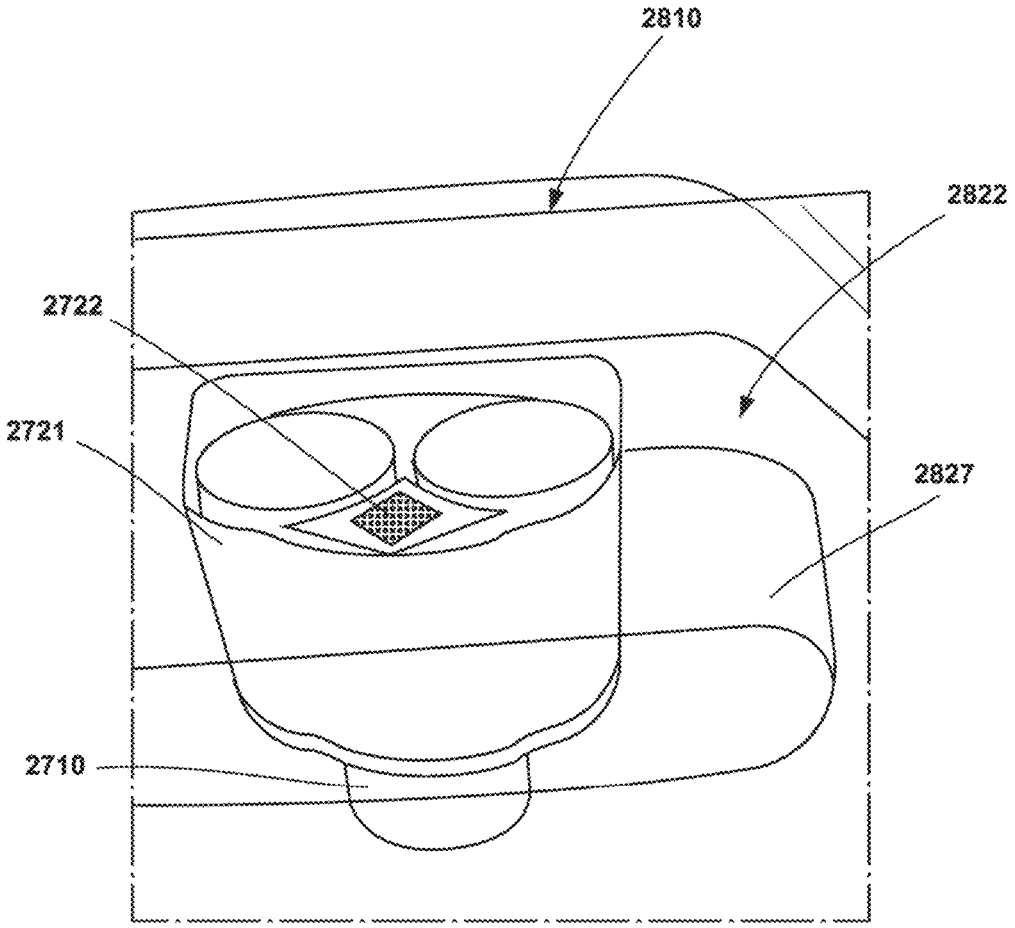
FIG. 13 is a side view photograph of a portion of the packaging assembly shown in FIG. 3, showing a reagent module within a second volume of a tray member, the reagent module including a label that is visible through the tray member.

The tray member 2810 can be constructed from any suitable material (or materials) that provides the environmental stability (e.g., that limits the moisture ingress) as described herein. In some embodiments, the tray member 2810 can be constructed from a cyclic olefin copolymer film, such as Tekniflex COC P12P-1, ACLAR® fluoropolymer films, or any suitable polymer film that can withstand high temperatures. In some embodiments, the tray member 2810 can be constructed from a transparent material so that a user can see through the tray member 2810 to view the internal components contained in the first volume 2812 and/or the second volume 2822. In this manner, a user (or device) can read labels, information and/or an indicium attached to the internal components through the tray member 2810. For example, FIGS. 12 and 13 show photographs of a bottom view of the tray member 2810 where the tray member is transparent and the label 2721 of the reagent module 2710 can be read by a user. FIG. 13 also shows a machine-readable code 2722 (or indicium) that is affixed to the reagent module 2710, and that is visible through the tray member 2810. In this manner, the machine-readable code 2722 can be scanned through the transparent tray member 2810 to identify the contents of the reagent module 2710. The machine-readable code can be any suitable code, such as a quick response (QR) code, a bar code or the like.

In some embodiments, the tray member 2810 (or any of the tray members described herein) can be constructed from multiple pieces that are later joined together. In this manner, certain portions of the tray member 2810 can have desired properties (e.g., thickness, material specifications, etc.) that produce the desired moisture ingress rate. In other embodiments, however, the tray member 2810 can be monolithically constructed. For example, the tray member 2810 (or any of the tray members described herein) can be produced by the following manufacturing methods: injection molding, thermoforming, pressure forming, blow molding, cold forming, die cutting, stamping, extruding, machining, drawing, casting, or laminating.

Regardless of the method of construction, the tray member 2810 can have the desired thickness to limit moisture ingress therein. Similarly stated, the overall thickness of the tray member 2810 (or any of the tray members described herein) can be any suitable value that, in conjunction with the material from which the tray is constructed, produces the desired environmental stability (e.g., that limits the moisture ingress), as described herein. Moreover, the spatial variability of the thickness can be maintained within a desired range to limit "thin spots" that allow excess moisture ingress. For example, in some embodiments, the thickness of the tray member 2810 is between about 0.06 mm (0.0024 inches) and about 0.6 mm (0.024 inches).

Figure 14:
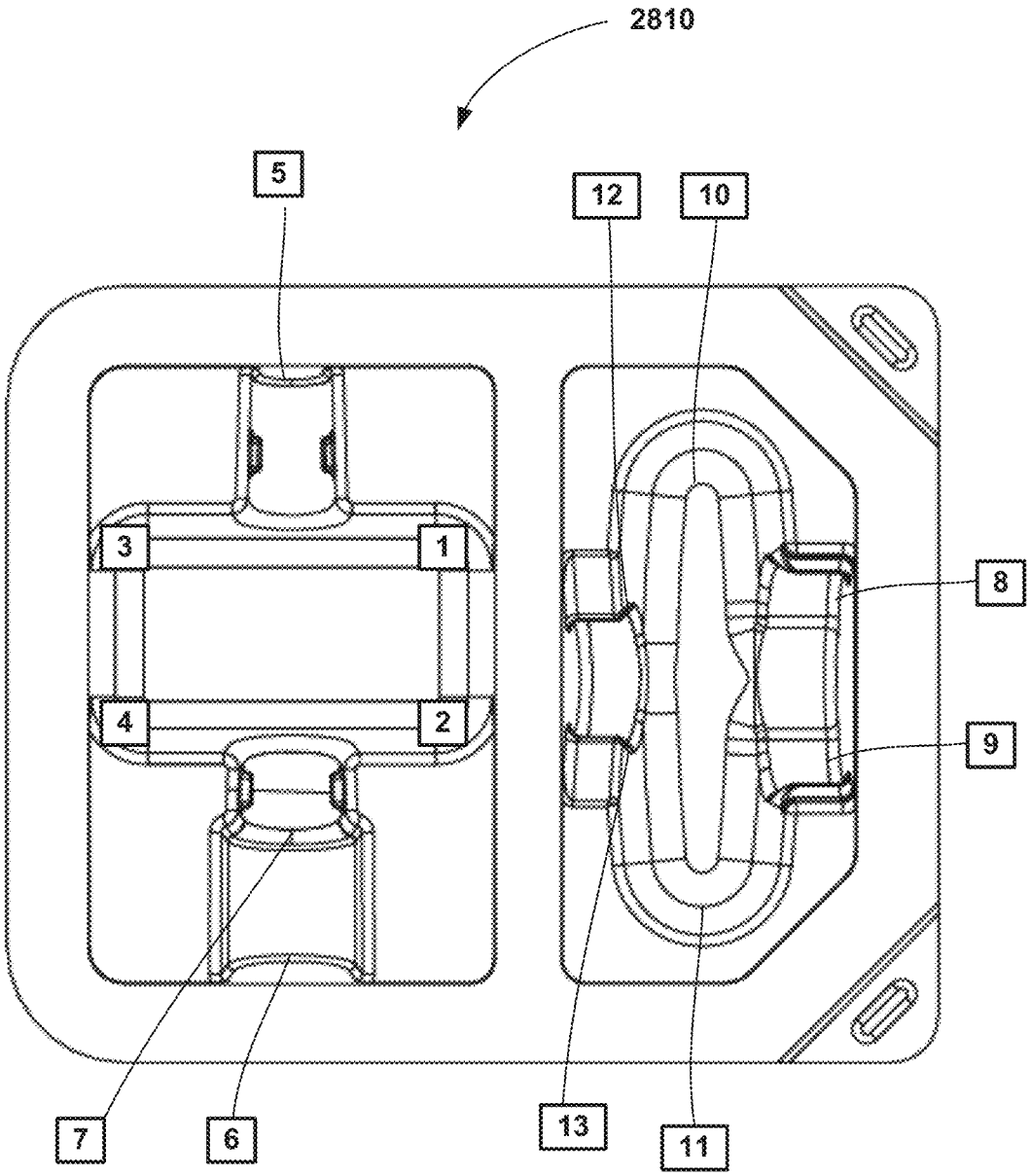
FIG. 14 is a top view of a packaging assembly according to an embodiment, showing various points on a tray member at which measurements of the tray member thickness were taken.

FIG. 14 shows a top view of the tray member 2810 marked at thirteen different spatial locations. A series of twenty tray members 2810 were measured at each of the enumerated locations to determine the tray thickness at each location. In this manner, for example, the experimental results could identify areas of lower (or greater) thickness. Based on the experimental results, the tray members were found to have a thickness in a range between approximately 0.05 mm (0.002 inches) to approximately 0.19 mm (0.0074 inches), as summarized in Table 1 below.

TABLE 1

Thickness measurements at specific points on a tray member (refer to FIG. 14 for the location of each specific point on a tray member).

| LOCATION | MIN (in) | MAX (in) | AVERAGE |
|---|---|---|---|
| 1 | 0.0056 | 0.0066 | 0.0061 |
| 2 | 0.0056 | 0.0072 | 0.0062 |
| 3 | 0.0048 | 0.0074 | 0.0061 |
| 4 | 0.0057 | 0.0072 | 0.0063 |
| 5 | 0.0026 | 0.0038 | 0.0033 |
| 6 | 0.0033 | 0.0048 | 0.0040 |
| 7 | 0.0046 | 0.0071 | 0.0057 |
| 8 | 0.0035 | 0.0047 | 0.0039 |
| 9 | 0.0036 | 0.0044 | 0.0040 |
| 10 | 0.0041 | 0.0061 | 0.0050 |
| 11 | 0.0043 | 0.0065 | 0.0050 |
| 12 | 0.0021 | 0.0033 | 0.0025 |
| 13 | 0.0021 | 0.0037 | 0.0029 |

Figure 11:
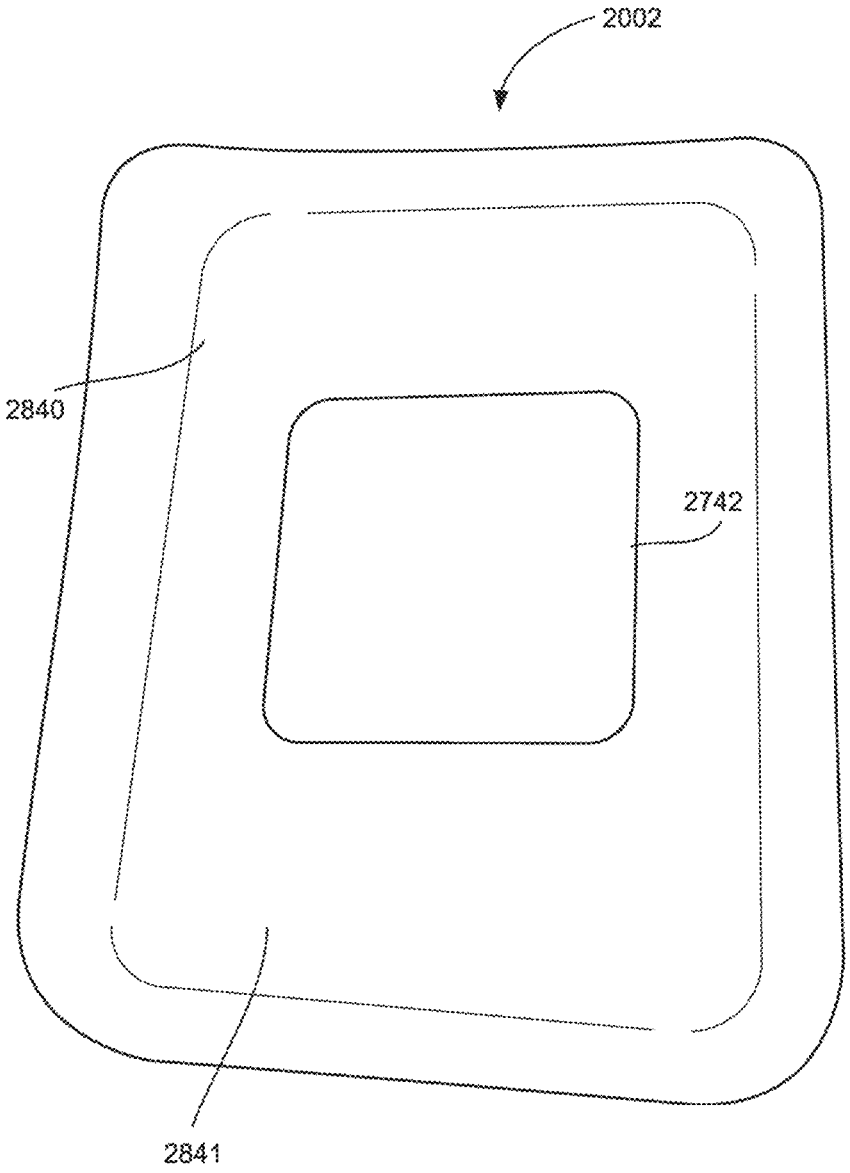
FIG. 11 is a top view photograph of the packaging assembly shown in FIG. 3, showing a label affixed to a cover member of the packaging assembly.

As shown in FIG. 3, the cover member 2840 has a first side (or outer side) 2841 and a second side (or inner side) 2845. The first side 2841 is exposed to the outside environment and is the surface to which labels can be affixed to designate the contents within the package assembly 2002. For example, FIG. 11 shows a photograph of the package assembly 2002 that includes a label 2720 on the outer side 2741 of the cover member 2740. In some embodiments, the outer side 2741 can include a material that allows information, indicium or labeling to be preprinted prior to the cover member 2740 being bonded to the tray member 2810. In some embodiments, the outer side 2741 includes a protective coating to cover the labels or pre-printed information. Such coatings can include, for example, polypropylene or polyethylene. Moreover, in some embodiments, the outer side 2741 can also accommodate post-assembly printing or instructions (e.g., information or graphics that are placed on the outer side 2741 after the cover member 2740 is bonded to the tray member 2810). Such post-printed information can include, for example, the date of manufacture, the expiration date, a lot code, or the like.

The second side 2845 is the side of the cover member 2840 that is bonded to the top portion of the tray member 2810, including the central portion 2811 of the tray member 2810, when the package assembly 2002 is in a first configuration. The cover member 2840 can be constructed from any suitable material (or materials) that provides the environmental stability (e.g., that limits the moisture ingress) as described herein. For example, in some embodiments, the cover member 2840 is constructed from a polyolefin material, such as Teknilid WPSPPE. In other embodiments, the cover member can be made of WPSUnipeel. The cover member 2840 can be bonded to the top portion of the tray member 2810 by any of the methods described herein.

Figure 15:
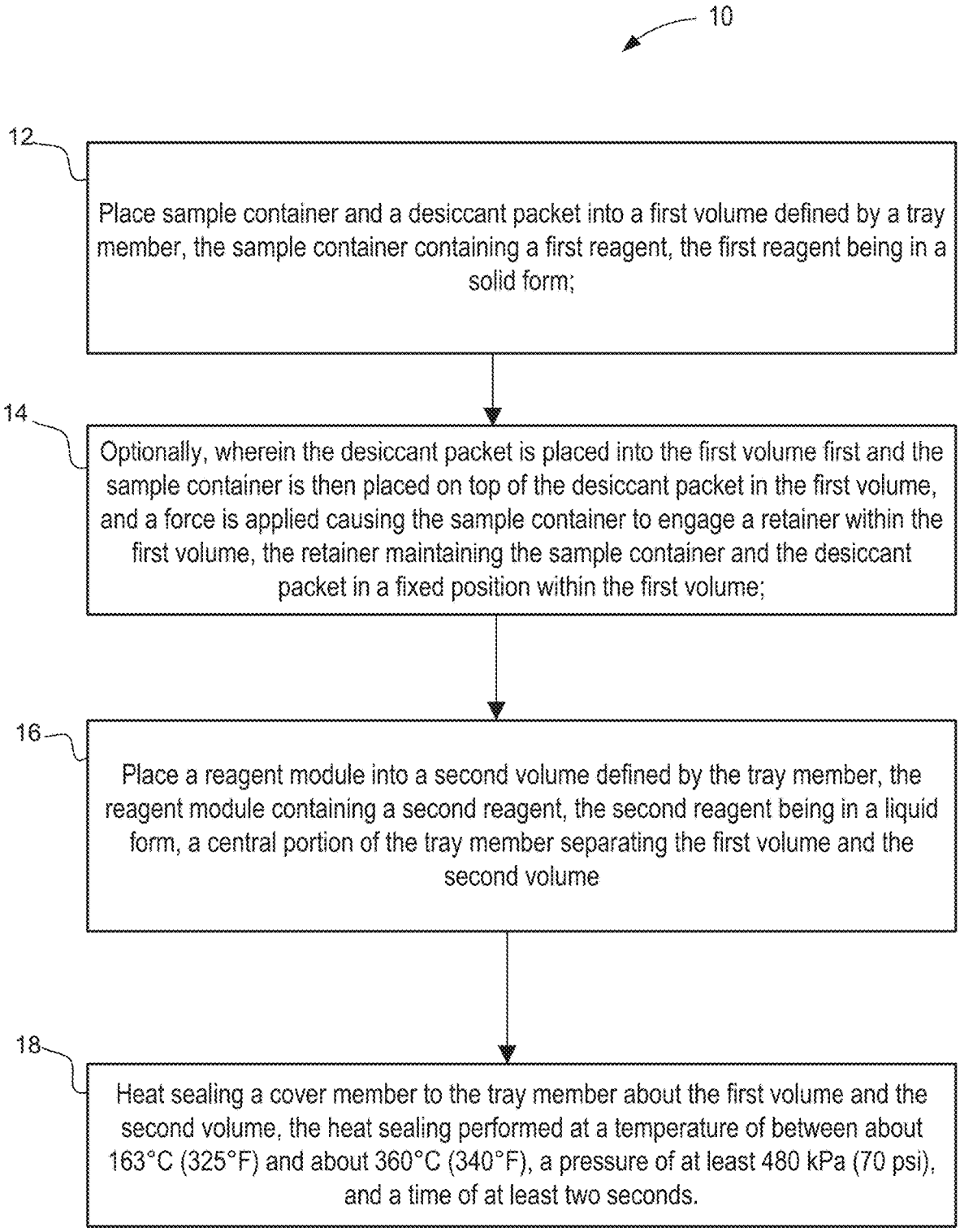
FIG. 15 is a flow chart of a method of packaging a diagnostic test cartridge according to an embodiment.

The package assembly 2002 or any of the package assemblies described herein can be assembled using any suitable process. Such processes can include, for example, heat sealing the cover member 2840 to the tray member 2810 under conditions that limit the moisture ingress into the package assembly 2002. For example, FIG. 15 shows the method of assembly 10 of a packaging assembly according to an embodiment. The method includes placing the sample container and the desiccant packet into a first volume defined by a tray member, at 12. The sample container containing a first reagent. The first reagent is in a solid form. The tray member can be any of the tray member shown and described herein, such as, for example, the tray member 2810.

The sample container and the desiccant packet can be placed into the first volume in any suitable manner. For example, in some embodiments, the method 10 optionally includes inserting the desiccant packet into the first volume at a first time, and then placing the sample container on top of the desiccant packet in the first volume, at 14. When the sample container is placed in the first volume a force is applied causing the sample container to engage a retainer within the first volume that maintains the sample container and the desiccant packet in a fixed position within the first volume. The retainer can be any of the retainers shown and described herein.

A reagent module is placed into a second volume defined by the tray member, at 16. The reagent module contains a second reagent that is in a liquid form. A central portion of the tray member separates the first volume and the second volume. As described above, the central portion can minimize moisture ingress from the second volume into the first volume.

Figure 16:
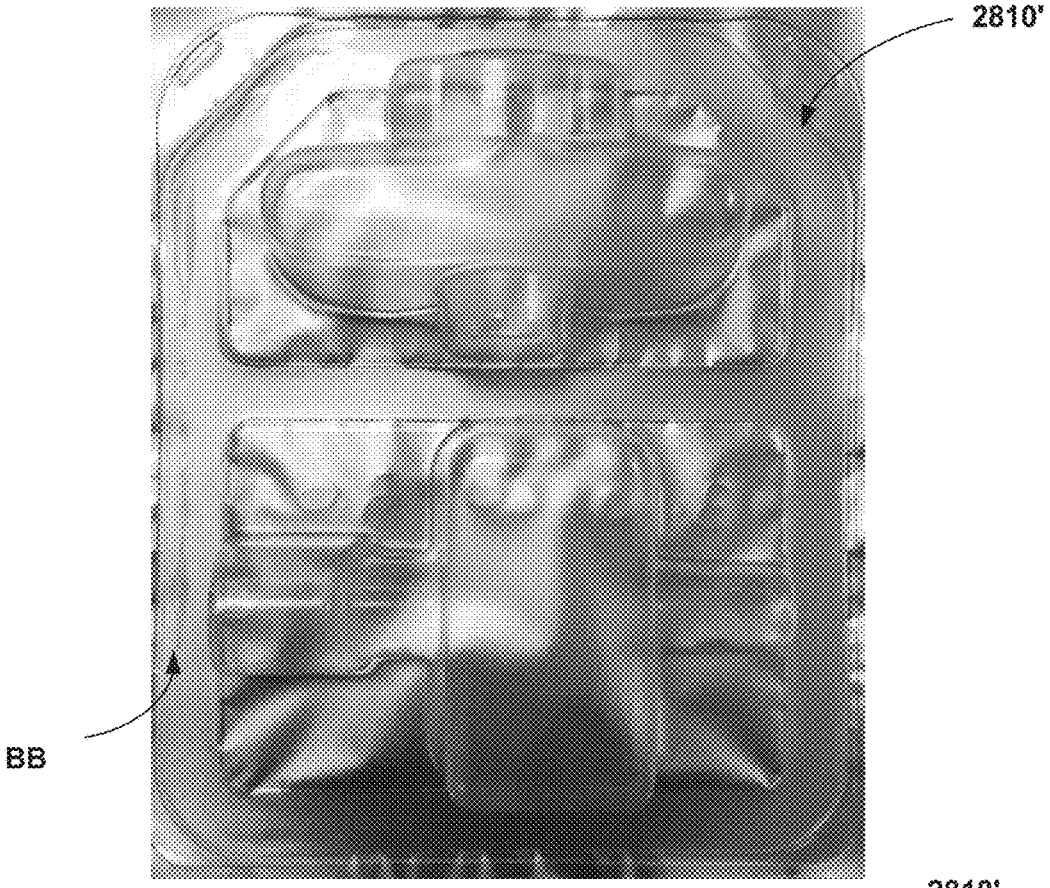
FIGS. 16-17 are bottom view photographs of packaging assemblies according to various embodiments, showing an interface between the tray member and the cover member formed.
Figure 17:
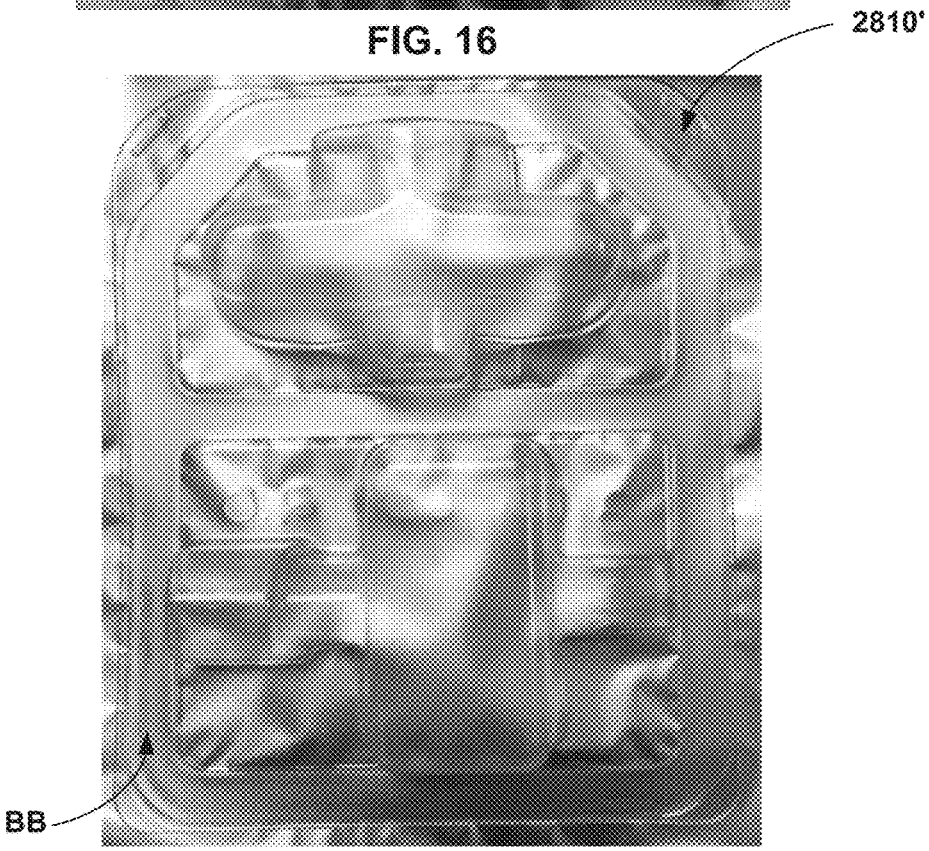

A cover member is then heat sealed to the tray member about the first volume and the second volume, at 18. The cover member can be any of the cover members described herein. The heat sealing is performed at a temperature of between 163° C. (325° F.) and about 360° C. (340° F.) with a pressure of at least 480 kPa (70 psi) for at least two seconds. The range of conditions for the heat sealing operation was determined based on performance tests run on assemblies that were heat sealed at a variety of different assembly conditions. For example, one method for determining the integrity of the heat seals to inspect the heat-sealed area for bubbles. The presence of bubbles or other visually-evident imperfections can indicate that the seal is more likely to allow moisture therethrough than a seal with fewer imperfections. Said another way, a seal is successful if there are minimal small air pockets or no bubbles. For example, FIGS. 16 and 17 are bottom view photographs of two tray assemblies 2810' according to an embodiment that include a cover member heat sealed to a tray, as described herein. Specifically, FIG. 16 shows an unsuccessful seal as evidenced by a bubble line BB along the left edge of the cover member. FIG. 17 also shows an unsuccessful seal as evidenced by a small air pocket BB on the lower left edge of the cover member. These examples are provided to show imperfections that are indicative of a seal that may not provide the desired moisture ingress limits. Similarly stated, the imperfections are such that the expected total moisture ingress into the first volume after 180 days when the tray member is maintained at a temperature of up to 40° C. and a relative humidity of up to 75 percent may not be less than an adsorption capacity of the desiccant packet—thus, the assemblies 2810' of FIGS. 16 and 17 may not achieve the desired long term storage.

Test Results

Figure 18:
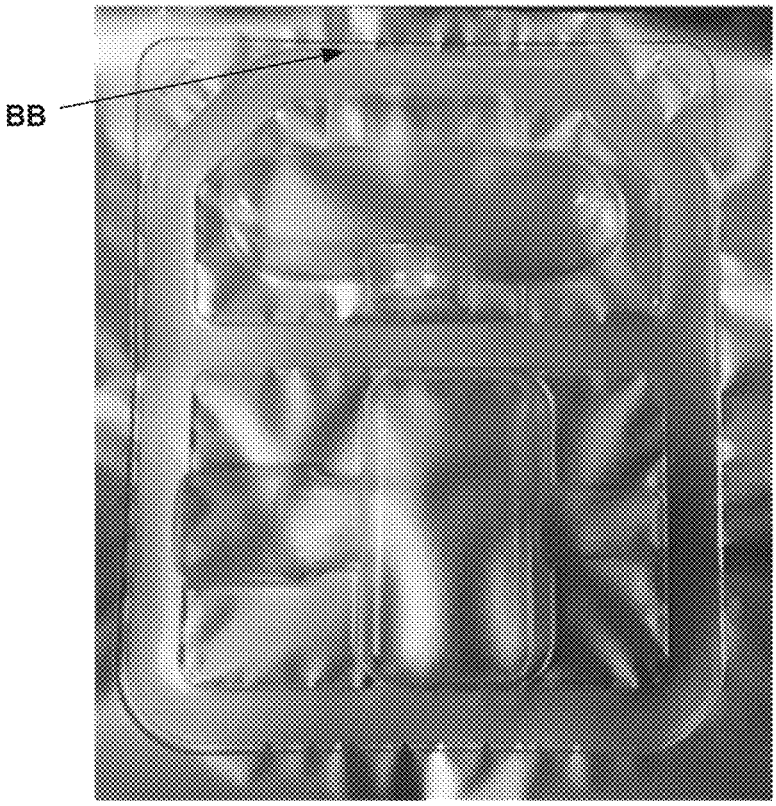
FIGS. 18-22 are bottom view photographs of packaging assemblies according to various embodiments, showing an interface between the tray member and the cover member formed at heat sealing temperatures of 325° F., 330° F., 335° F., 340° F., and 345° F., respectively.

To evaluate the performance of the heat sealing operation a series of tests were run using different heat sealing temperatures. Tests were run varying the heat sealing temperature from 290° F. up to 345° F. The pressure was maintained at 90 psi, and the heat sealing time was 2.0 seconds. A sample size of eight tray assemblies were sealed at each temperature, the results were analyzed both visually (to inspect for bubbles and seal imperfections) and by measuring the peel strength of the cover member. The test results are shown in FIGS. 18-22 and in Table 2 below. FIG. 18 shows a packaging assembly that was heat sealed at a temperature of 325° F. and a pressure of 90 psi for 2.0 seconds. This seal was unsuccessful as there is a bubble BB on the top edge of the cover member. As indicated in Table 2, however, only one of the eight samples experienced this undesirable bubbling. Moreover, the peel strength was above the desired value of 4 lb/in. Conversely, the tests run at temperatures below 325° F. showed considerably lower peel strength and higher incidences of bubbling and seal imperfections. Thus, in some embodiments, a method of assembly includes heat sealing a cover member to a tray member about the first volume and the second volume, at a temperature of about 325° F. with a pressure of at least 90 psi for at least two seconds.

TABLE 2

Thickness measurements at specific points on a tray member (refer to FIG. 14 for the location of each specific point on a tray member).

| Parameter Set | | 1 | 2 | 3 | 4 | 5 | 6 | 7 |
|---|---|---|---|---|---|---|---|---|
| Heat Sealing Parameters | Temp. [F] | 290 | 300 | 325 | 330 | 335 | 340 | 345 |
| | Time [sec] | 2.0 | 2.0 | 2.0 | 2.0 | 2.0 | 2.0 | 2.0 |
| | Pressure [PSI] | 90 | 90 | 90 | 90 | 90 | 90 | 90 |
| #Samples bubble | #/8 | 6/8 | 5/8 | 1/8 | 1/8 | 0/8 | 2/8 | 3/8 |
| Maximum Peel Strength Per Sample Number [lb/in] | 1 | 2.85 | 2.72 | 4.20 | 4.71 | 5.79 | 5.50 | 6.37 |
| | 2 | 2.75 | 2.95 | 4.01 | 6.31 | 7.29 | 5.35 | 7.37 |
| | 3 | 2.50 | 3.82 | 6.49 | 4.61 | 6.53 | 6.99 | 6.41 |
| | 4 | 2.85 | 2.65 | 4.96 | 7.32 | 6.92 | 7.11 | 6.88 |
| | 5 | 2.77 | 2.54 | 6.36 | 7.08 | 7.46 | 7.78 | 6.67 |
| | 6 | 2.46 | 1.95 | 7.09 | 7.41 | 4.83 | 6.53 | 6.51 |
| | 7 | 2.70 | 3.90 | 4.25 | 6.75 | 6.47 | 7.34 | 6.09 |
| | 8 | 3.08 | 2.94 | 6.66 | 4.68 | 6.13 | 8.33 | 7.55 |
| Average [lb/in] | | 2.71 | 2.94 | 5.50 | 6.12 | 6.43 | 6.87 | 6.73 |
| Standard Deviation [lb/in] | | 0.15 | 0.65 | 1.27 | 1.24 | 0.85 | 1.04 | 0.50 |
| CV [%] | | 5.43 | 22.13 | 23.14 | 20.29 | 13.27 | 15.14 | 7.48 |
| Pass/Fail [P/F] | | F | F | P | P | P | P | P |

Figure 19:
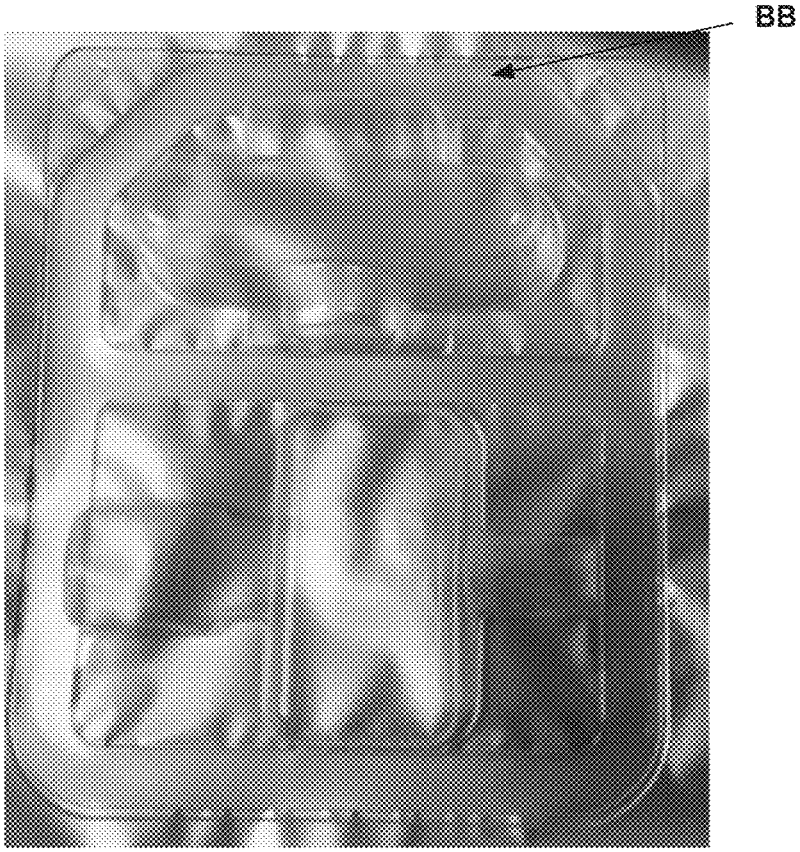

FIG. 19 shows a packaging assembly that was heat sealed at a temperature of 330° F. and a pressure of 90 psi for 2.0 seconds. This seal was unsuccessful as there is a bubble BB on the top edge of the cover member. As indicated in Table 2, however, only one of the eight samples experienced this undesirable bubbling. Moreover, the peel strength was above the desired value of 4 lb/in. Thus, in some embodiments, a method of assembly includes heat sealing a cover member to a tray member about the first volume and the second volume, at a temperature of about 330° F. with a pressure of at least 90 psi for at least two seconds.

Figure 20:
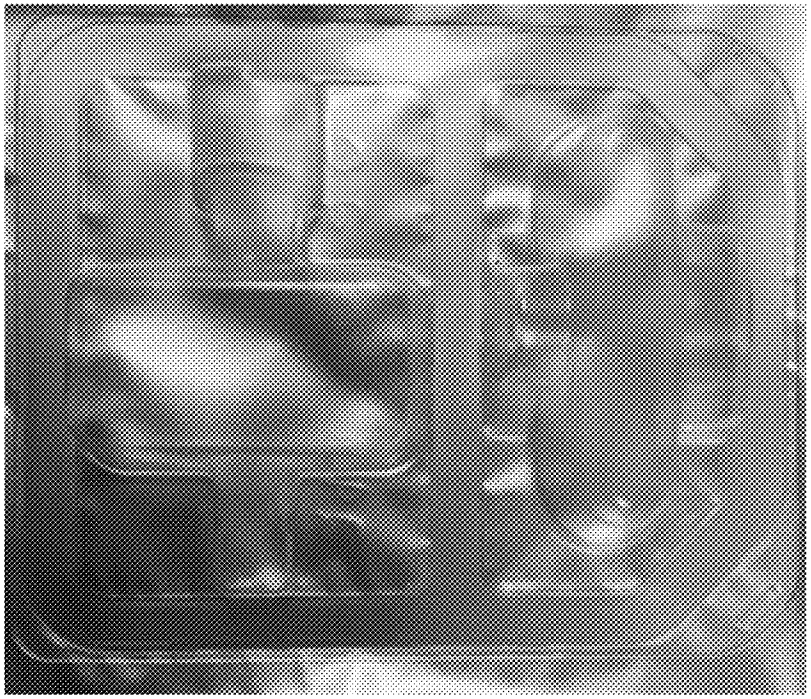

FIG. 20 shows a packaging assembly that was successfully heat sealed at a temperature of 335° F. and a pressure of 90 psi for 2.0 seconds. As shown, there are no visual imperfections in the seal. Additionally, as noted in Table 2, all eight samples tested were devoid of undesirable bubbling. Moreover, the peel strength was above the desired value of 4 lb/in. Thus, in some embodiments, a method of assembly includes heat sealing a cover member to a tray member about the first volume and the second volume, at a temperature of about 335° F. with a pressure of at least 90 psi for at least two seconds.

Figure 21:
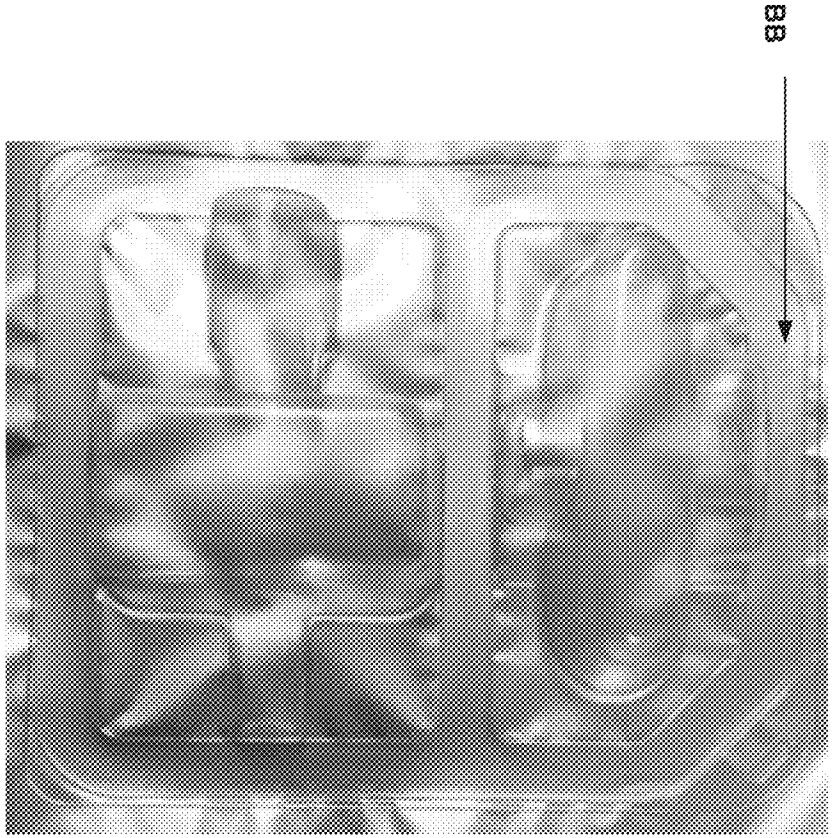
Figure 22:
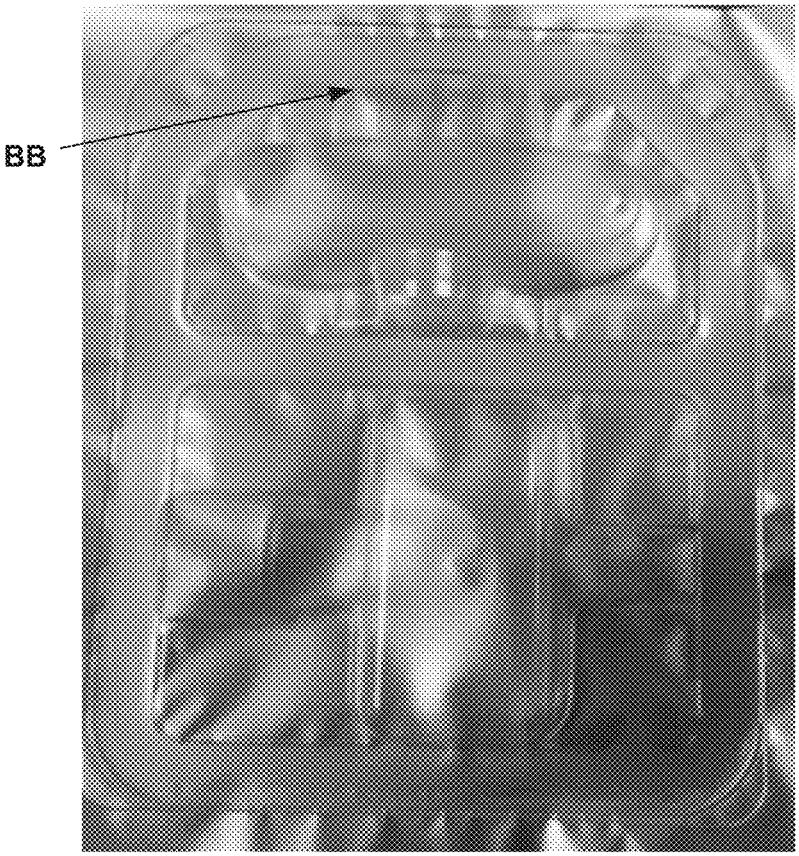

Further increasing the heat sealing temperature, however, did not result in continued improvement. Specifically, at a heat sealing temperature of 340° F. two of the eight samples had undesirable bubbles. For example, FIG. 21 shows a packaging assembly that was heat sealed at a temperature of 340° F. and a pressure of 90 psi for 2.0 seconds. FIG. 22 shows a packaging assembly that was heat sealed at a temperature of 345° F. and a pressure of 90 psi for 2.0 seconds. At this temperature, the tray began bending and numerous bubbles formed on the bottom edge. Thus, in some embodiments, a method of assembly includes heat sealing a cover member to a tray member about the first volume and the second volume, at a temperature of about 340° F. or less, with a pressure of at least 90 psi for at least two seconds.

Figure 24:
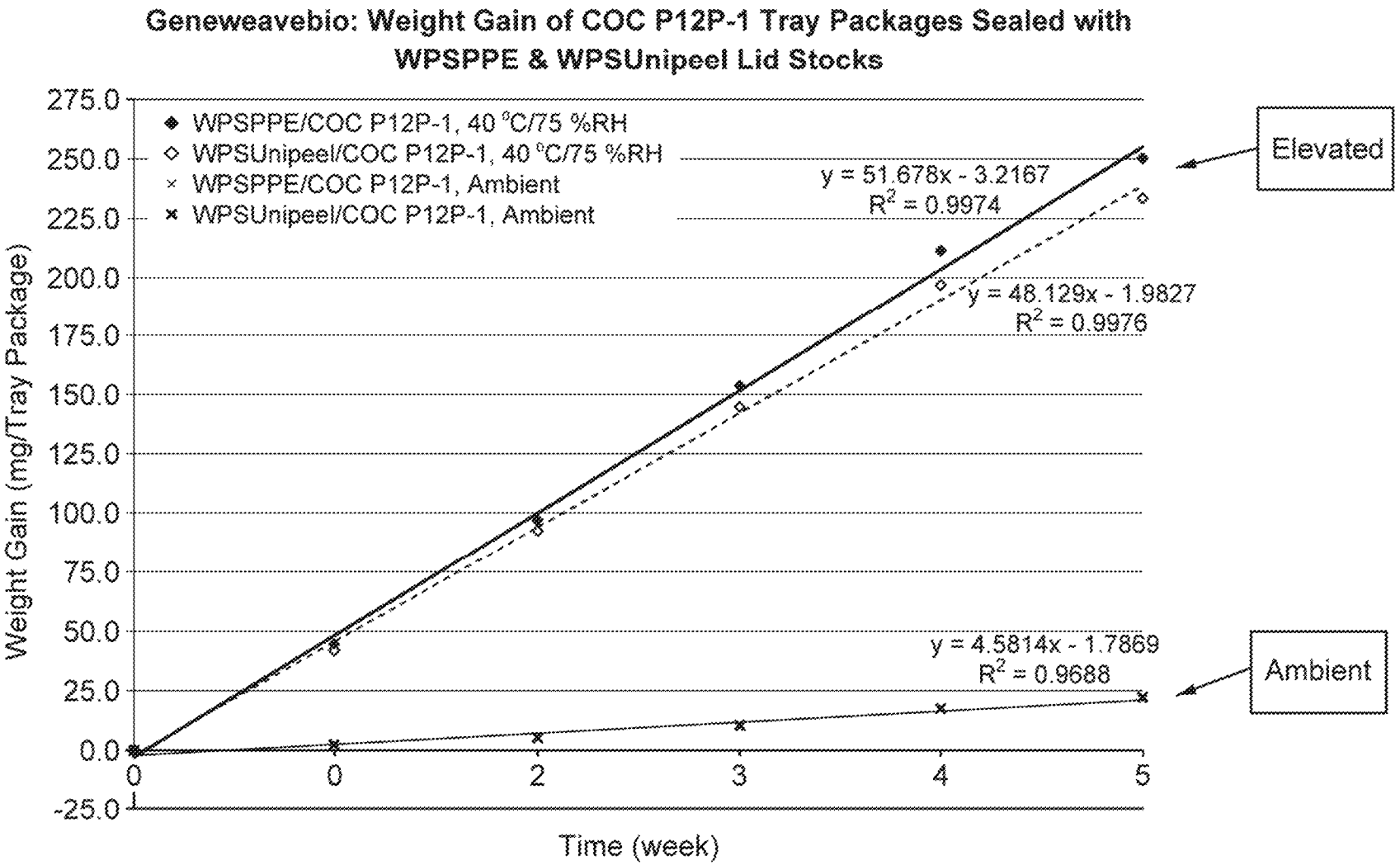
FIG. 24 is a graph showing the weight gain as a function of time (due to moisture vapor transfer) for a packaging assembly, according to an embodiment.

In another study, the moisture vapor transmission rate (MVTR) of twenty packaging assemblies according to various embodiments was measured over a period of five weeks. Four different packaging assemblies were tested: (1) assemblies including a cover member made from Teknilid WPSPPE and a tray member made from Tekniflex COC P12P-1 in an environment having a temperature of 40° C. and 75% relative humidity (identified as WPSPPE/COC P12P-1, 40° C./75% RH), (2) assemblies including a cover member made from WPSUnipeel and a tray member made from Tekniflex COC P12P-1 in an environment having a temperature of 40° C. and 75% relative humidity (identified as WPSUnipeel/COC P12P-1, 40° C./75% RH), (3) assemblies including a cover member made from Teknilid WPSPPE and a tray member made from Tekniflex COC P12P-1 in an ambient environment (identified as WPSPPE/COC P12P-1, Ambient), and (4) assemblies including a cover member made from WPSUnipeel and a tray member made from Tekniflex COC P12P-1 in an ambient environment (identified as WPSUnipeel/COC P12P-1, Ambient). FIG. 24 shows the weight gain of the packaging assemblies over a five-week duration. The two designs tested at 40° C. and 75% relative humidity are referred to as "elevated." The raw data is provided in Table 3. The weight gain over the five-week period was assumed to be due to moisture ingress into the assembly. These test results were used to determine the moisture vapor transmission rate, which was then used to extrapolate the total moisture ingress at 6 months and 12 months. In this manner, the shelf-life for each package assembly could be determined.

TABLE 3

MVTR of Raw Test Data

| Variable | 1 week-wt. gain (mg)/week | 2 week-wt. gain (mg)/week | 3 week-wt. gain (mg)/week | 4 week-wt. gain (mg)/week | 5 week-wt. gain (mg)/week | Average (mg) | Min (mg) | Max (mg) | Stdv |
|---|---|---|---|---|---|---|---|---|---|
| WPSPPE/COC P12P-1, elevated | 43.9 | 97.2 | 153.7 | 210.9 | 250.2 | 50.04 | 39.3 | 57.2 | 8.01 |
| WPSUni-peel/COC P12P-1, elevated | 41.9 | 92.8 | 145.0 | 196.8 | 233.5 | 46.7 | 36.7 | 52.2 | 7.02 |
| WPSPPE/COC P12P-1, Ambient | 2.7 | 5.7 | 10.7 | 17.5 | 22.0 | 4.40 | 2.7 | 6.8 | 1.66 |
| WPSUni-peel/COC P12P-1, Ambient | 2.7 | 5.1 | 10.6 | 17.2 | 22.3 | 4.46 | 2.4 | 6.6 | 1.83 |

As shown in FIG. 24 and Table 3, the average weight gain of the Teknilid packaging assemblies in the ambient environment was 4.40 mg/7 days. The average weight gain of the Teknilid packaging assemblies in the elevated environment was 50.04 mg/7 days. The total surface area of the packaging assemblies was determined to be 23.54 $in^2$ (surface area of the first volume is 13.47 $in^2$ and the surface area of the second volume is 10.07 $in^2$). Thus, the MVTR for the Teknilid package assembly was calculated as 0.0006 g/100 in2/day at ambient and 0.0071 g/100 in2/day at the elevated conditions. Based on this, Table 4 includes the extrapolated moisture ingress amount at 6 months and at 12 months.

The desiccant in the packaging assemblies was calculated as having an adsorption capacity of 0.57 g. This calculation was based on a desiccant mass of 3 g multiplied by the adsorption percentage (19% at room temperature). Thus, because the total ingress amount is less than the adsorption capacity of the desiccant, the calculations show that the package assemblies tested have a shelf life of at least six months for both ambient and elevated (e.g., 40° C./75% relative humidity) conditions. In some embodiments, a package assembly can have a shelf life of up to 12 months.

TABLE 4

Summary of the MVTR of Packaging Assemblies

| Samples | MVTR Per Package (g/day/pkg) | MVTR Per Assay Tube Cavity (g/day/pkg) | MVTR during packaging (gram) | Adsorption Rate 6 months | Adsorption Rate 12 months |
|---|---|---|---|---|---|
| WPSPPE/COC P12P-1 at Ambient | 0.00014 | 0.00008 | 0.00148 | 0.26640 | 0.53280 |
| WPSPPE/COC P12P-1 at Elevated | 0.0017 | 0.000071 | 0.00148 | 0.26478 | 0.52956 |

Figure 25:
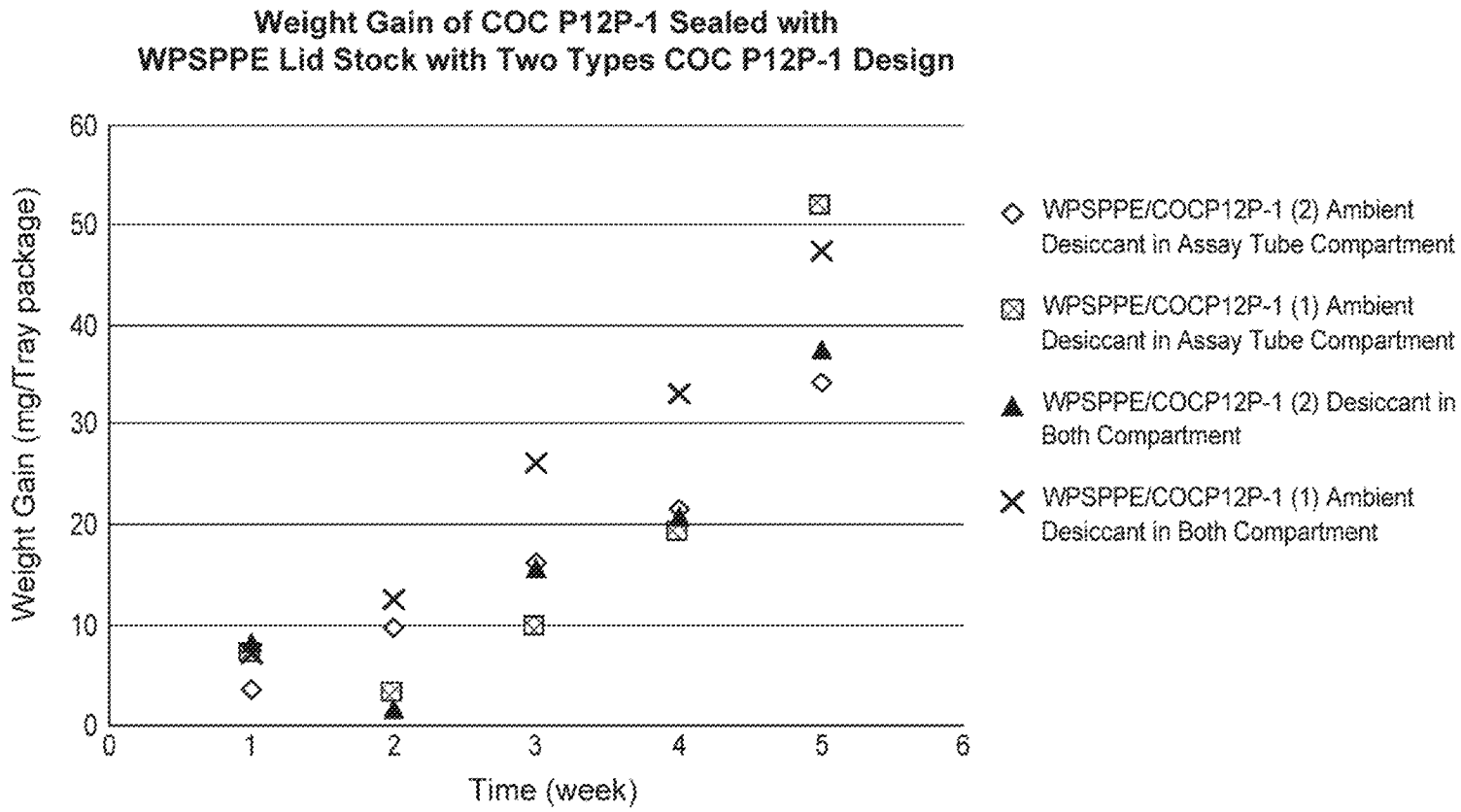
FIG. 25 is a graph showing the weight gain as a function of time (due to moisture vapor transfer) for a packaging assembly including different cover members, according to various embodiments.

FIG. 25 show a plot of an additional test showing weight gain of various package assemblies.

While various embodiments have been described above, it should be understood that they have been presented by way of example only, and not limitation. Where methods and/or schematics described above indicate certain events occurring in certain order, the ordering of certain events may be modified. Additionally, certain events may be performed concurrently in parallel processes when possible, as well as performed sequentially. While the embodiments have been particularly shown and described, it will be understood that various changes in form and details may be made.

For example, any of the sample containers described herein, including the sample containers 1732, 2732, can be formed from any suitable material, for example, glass, plastic (e.g., polypropylene), acrylic, etc. In some embodiments, any of the sample containers described herein, including the sample containers 1732, 2732, can be formed from a lightweight, rigid and/or inert 3 material. At least a portion of a sample container (e.g., the distal end portion) can be at least partially transparent to allow viewing, optical access and/or detection of the internal volume of the sample container. In some embodiments, the distal end portion of any of the sample containers described herein, including the sample containers 1732, 2732, can be polished to promote optimal transmission of light therethrough. Moreover, although the sample containers are shown herein as having a specific shape (e.g., the sample container 2732 is shown as being substantially cylindrical), any of the sample containers described herein can have any other suitable shape, e.g., cylinder, square, oval, polygonal, elliptical, conical, etc. For example, in some embodiments, a sample container can have a substantially flat bottom. In some embodiments, a sample container (including the sample container 1732 or the sample container 2732) can be a test tube.

Any of the reagent modules described herein, including the reagent module 1710 and the reagent module 2710, can be constructed from materials that are substantially impermeable to and/or substantially chemically inert from the substance contained therein and the outside environment. In some embodiments, any of the reagent modules described herein, including the reagent module 1710 and the reagent module 2710, can be formed from a lightweight, rigid and/or inert material. In some embodiments, at least a portion of a reagent module can be constructed from a material (e.g., polymer film, such as any form of polypropylene) having certain temperature characteristics such that the desired properties and integrity are maintained over a certain temperature. For example, in some instances, it can be desirable to store a reagent module (including the reagent module 1710 and the reagent module 2710) containing a reagent and/or substrate in a refrigerated condition. In some embodiments, a portion of any of the reagent modules described herein, including the reagent module 1710 and the reagent module 2710, can be constructed from bi-axially oriented polypropylene (BOP). In some embodiments, a portion of any of the reagent modules described herein, including the reagent module 1710 and the reagent module 2710, can be constructed from aluminum. In some embodiments, a portion of any of the reagent modules described herein, including the reagent module 1710 and the reagent module 2710, can be constructed from polyvinyl chloride (PVC), ethylene vinyl alcohol (EVOH), polyethylene (PE) and/or polychlorotrifluoroethene (PCTFE or PTFCE).

Although the second volume 1822 of the tray member 1810 is shown and described as containing a reagent module 1710 that contains a second (liquid) reagent 1783, in other embodiments, the second volume 1822 (and any of the second volumes described herein) and/or the reagent module 1710 (and any of the reagent modules described herein) can include any suitable number of reagents, in any suitable form. For example, in some embodiments, the reagent module 1710 or the reagent module 2710 (and any of the reagent modules described herein) can include two or more liquid reagents. In some embodiments, the second volume 1822 and the second volume 2822 (and any of the second volumes described herein) can also include a dry reagent.

In some embodiments, the package assembly 2002 (or any of the package assemblies described herein) can include a transfer pipette or other suitable device used to transfer a patient sample from a sample collection container into a reaction tube (e.g., the sample container 2732 or a similar assay container).

Although package assembly 2002 is shown as including a sample (or assay) container assembly 2730 that includes a single sample container or reaction chamber 2732, in other embodiments, a package assembly can include a sample container used to collect the raw sample and an assay container assembly (e.g., similar to the assay container assembly 2730).

Although various embodiments have been described as having particular features and/or combinations of components, other embodiments are possible having a combination of any features and/or components from any of embodiments as discussed above. Aspects have been described in the general context of molecular diagnostic devices, but inventive aspects are not necessarily limited to use in molecular diagnostics, health care, and/or medical devices.

What is claimed is:

1. An apparatus, comprising:

a tray member defining a first volume and a second volume, the tray member including a flange, a central portion of the tray member separating the first volume and the second volume, a top surface of the central portion being coplanar with the flange;

a sample container removably disposed within the first volume, the sample container containing a first reagent, the first reagent being in a solid form;

a desiccant packet within the first volume;

a reagent module removably disposed within the second volume, the reagent module including a housing configured to be coupled to the sample container, the reagent module containing a second reagent, the second reagent being in a liquid form; and a cover member in contact with the flange and the top surface of the central portion to entirely cover the first volume and the second volume from an ambient environment and seal the first volume from the second volume to minimize moisture transfer between the first volume and the second volume.

2. The apparatus of claim 1, wherein:

the cover member and the tray member are collectively configured such that an expected total moisture ingress into the first volume after 180 days upon the tray member having been maintained at a temperature of up to 40° C. and a relative humidity of up to 75 percent is less than an adsorption capacity of the desiccant packet.

3. The apparatus of claim 2, wherein the adsorption capacity of the desiccant packet is between 15 percent and 20 percent of a mass of the desiccant packet.

4. The apparatus of claim 3, wherein the desiccant packet includes any one of a Silica Gel, a clay, or a molecular sieve.

5. The apparatus of claim 1, wherein the tray member is monolithically constructed from a cyclic olefin copolymer film.

6. The apparatus of claim 5, wherein a thickness of the tray member is between about 0.06 mm and about 0.6 mm.

7. The apparatus of claim 1, wherein the cover member is constructed from a polyolefin material and is bonded to the flange of the tray member and the top surface of the central portion, the flange surrounding the first volume and the second volume.

8. The apparatus of claim 1, wherein the tray member includes a first retainer protrusion within the first volume and a second retainer protrusion within the second volume, the first retainer protrusion configured to maintain the sample container in a first fixed position within the first volume, the second retainer protrusion configured to maintain the housing of the reagent module in a second fixed position within the second volume.

9. The apparatus of claim 8, wherein:

a bottom portion of the tray member defines a first removal recess that is within the first volume and beneath the sample container when the sample container is in the first fixed position.

10. The apparatus of claim 8, wherein:

a bottom portion of the tray member defines a second removal recess that is within the second volume and beneath the reagent module when the reagent module is in the second fixed position.

11. The apparatus of claim 1, wherein:

the housing of the reagent module includes a label having an indicium, the tray member including a retainer protrusion within the second volume, the retainer protrusion maintaining the housing of the reagent module in a fixed position within the second volume, a portion of the tray member defining the second volume being transparent such that the indicium is visible through the portion of the tray member.

12. An apparatus, comprising:

a tray member defining a first volume and a second volume, a central portion of the tray member separating the first volume and the second volume, the tray member including a flange, the flange and a top surface of the central portion forming a coplanar sealing area, the tray member being constructed from a cyclic olefin copolymer film;

a sample container disposed within the first volume, the sample container containing a first reagent, the first reagent being in a solid form;

a desiccant packet disposed within the first volume, the desiccant packet comprising any of a silica gel, an activated alumina, clay, or a molecular sieve;

a reagent module disposed within the second volume, the reagent module including a housing containing a second reagent, the second reagent being in a liquid form; and a cover member constructed from a polyolefin material, the cover member sealed to the coplanar sealing area of the flange and the top surface of the central portion to entirely cover the first volume and the second volume from an ambient environment, the cover member and the tray member sealing the first volume from the second volume such that an expected total moisture ingress into the first volume after 180 days upon the tray member having been maintained at a temperature of up to 40° C. and a relative humidity of up to 75 percent is less than an adsorption capacity of the desiccant packet.

13. The apparatus of claim 12, wherein the cover member and the tray member are configured such that the expected total moisture ingress into the first volume after one year upon the tray member having been maintained at the temperature of up to 40° C. and the relative humidity of up to 75 percent is less than the adsorption capacity of the desiccant packet.

14. The apparatus of claim 12, wherein the adsorption capacity of the desiccant packet is between 15 percent and 20 percent of a mass of the desiccant packet.

15. The apparatus of claim 12, wherein:

the tray member includes a retainer protrusion within the first volume, the retainer protrusion configured to maintain the sample container and the desiccant packet in a fixed position within the first volume; and a bottom portion of the tray member defines a first removal recess that is within the first volume and beneath the sample container when the sample container is in the fixed position.

16. The apparatus of claim 15, wherein the desiccant packet is at least partially within the first removal recess.

17. The apparatus of claim 12, wherein the tray member is monolithically constructed, a thickness of the tray member being between about 0.06 mm and about 0.6 mm.

18. The apparatus of claim 12, wherein the reagent module includes a label having an indicium, the tray member including a retainer protrusion within the second volume, the retainer protrusion maintaining the reagent module a fixed position within the second volume, a portion of the tray member defining the second volume being transparent such that the indicium is visible through the portion of the tray member.

19. The apparatus of claim 18, wherein:

the portion of the tray member is a first portion; and a second portion of the tray member defines a second removal recess that is within the second volume and beneath the housing of the reagent module when the reagent module is in the fixed position.

20. The apparatus of claim 1, wherein:

the sample container is a sample tube having a cap that encloses the first reagent within the sample tube, the cap configured to be removed from an end portion of the sample tube; and the housing of the reagent module being configured to be directly coupled to the end portion of the sample tube.

21. The apparatus of claim 1, wherein:

the tray member includes a first retainer protrusion within the first volume, the first retainer protrusion configured to maintain the sample container in a first fixed position within the first volume;

a bottom portion of the tray member defines a first removal recess that is within the first volume and is beneath the sample container when the sample container is in the first fixed position; and the desiccant packet is within the first removal recess.

22. The apparatus of claim 21, wherein:

the desiccant packet is maintained within the first removal recess by a portion of the sample container.

23. The apparatus of claim 12, wherein:

the sample container is a sample tube having a cap that encloses the first reagent within the sample tube, the cap configured to be removed from an end portion of the sample tube; and the housing of the reagent module being configured to be directly coupled to the end portion of the sample tube.

* * * * *